US010473400B2

(12) United States Patent
Taylor et al.

(10) Patent No.: US 10,473,400 B2
(45) Date of Patent: Nov. 12, 2019

(54) DISPERSION APPARATUS

(71) Applicant: HATCH PTY LTD., Brisbane, Queensland (AU)

(72) Inventors: Wesley Adam Taylor, Warner (AU); Matthew George White, Brisbane (AU)

(73) Assignee: Hatch Pty Ltd., Brisbane, Queensland (AU)

( * ) Notice: Subject to any disclaimer, the term of this patent is extended or adjusted under 35 U.S.C. 154(b) by 132 days.

(21) Appl. No.: 15/029,056

(22) PCT Filed: Oct. 17, 2014

(86) PCT No.: PCT/AU2014/000995
§ 371 (c)(1),
(2) Date: Apr. 13, 2016

(87) PCT Pub. No.: WO2015/054739
PCT Pub. Date: Apr. 23, 2015

(65) Prior Publication Data

US 2016/0258685 A1 Sep. 8, 2016

(30) Foreign Application Priority Data

Oct. 17, 2013 (AU) ..... 2013904005

(51) Int. Cl.
*F27D 3/10* (2006.01)
*B05B 1/34* (2006.01)
(Continued)

(52) U.S. Cl.
CPC ..... *F27D 3/10* (2013.01); *B05B 1/341* (2013.01); *B05B 7/1486* (2013.01); *F27D 3/18* (2013.01); *C22B 5/14* (2013.01)

(58) Field of Classification Search
CPC ..... F27D 3/10; F27D 3/18; F27D 99/0033; B05B 1/341; B05B 1/3415; B05B 7/1486; F23D 1/00; C22B 5/14
(Continued)

(56) References Cited

U.S. PATENT DOCUMENTS 1,726,870 A * 9/1929 Trent ..... F23D 17/00 110/261
2,840,185 A * 6/1958 Norgren ..... F16N 7/32 184/109
(Continued)

FOREIGN PATENT DOCUMENTS

WO WO 97/47923 12/1997
WO 2009030808 A1 3/2009
(Continued)

OTHER PUBLICATIONS

International Search Report and Written Opinion for International Application No. PCT/AU2014/000995 dated Nov. 19, 2014 (11 pages).
(Continued)

*Primary Examiner* — Jason J Boeckmann
(74) *Attorney, Agent, or Firm* — Merchant & Gould P.C.

(57) ABSTRACT

There is provided a dispersion apparatus for use with a solid fuel burner. The dispersion apparatus comprises a passage through which particulate material may flow toward an outlet region for dispersal therefrom, the flow being at least in part rotational about the longitudinal axis of the passage. The dispersion apparatus also comprises a downstream guide means arranged within the passage at or near the outlet region, the downstream guide means configured to at least reduce the rotational motion so that the flow progresses toward the outlet region in a substantially uniform manner in a direction aligned with a longitudinal axis of the passage.

15 Claims, 13 Drawing Sheets

(51) Int. Cl.
*B05B 7/14* (2006.01)
*F27D 3/18* (2006.01)
*C22B 5/14* (2006.01)

(58) Field of Classification Search
USPC ..... 239/463, 467, 469, 487, 488, 502
See application file for complete search history.

(56) References Cited

U.S. PATENT DOCUMENTS 3,074,361 A 1/1963 Huge et al.
3,275,248 A * 9/1966 O'Brien ..... B05B 1/12 239/466
3,920,187 A * 11/1975 Willis ..... B05B 1/28 239/400
4,479,442 A * 10/1984 Itse ..... F23D 1/02 110/104 R
4,930,430 A 6/1990 Allen et al.
5,388,536 A * 2/1995 Chung ..... F23D 1/02 110/264
5,685,242 A * 11/1997 Narato ..... F23C 6/047 110/104 B
5,979,342 A * 11/1999 Leisse ..... F23D 1/02 110/104 B
6,116,171 A * 9/2000 Oota ..... F23C 6/045 110/263
7,717,701 B2 * 5/2010 D'Agostini ..... F23C 6/045 110/264
2007/0029409 A1 * 2/2007 Dupuis ..... B05B 1/341 239/463

FOREIGN PATENT DOCUMENTS

WO WO 2013/141311 9/2013
WO 2013149332 A1 10/2013

OTHER PUBLICATIONS

European Search Report and the Annex to the European Search Report in European Patent Application No. EP 14 85 4239 dated May 22, 2017, 7 pages.
European Patent Office Summons to attend oral proceedings pursuant to Rule 115(1) EPC in European Patent Application No. EP 14 85 4239.2 dated Apr. 18, 2019, 7 pages.

* cited by examiner

DISPERSION APPARATUS

This application is a National Stage Application of PCT/AU2014/000995, filed 17 Oct. 2014, which claims benefit of Serial No. 2013904005, filed 17 Oct. 2013 in Australia and which applications are incorporated herein by reference. To the extent appropriate, a claim of priority is made to each of the above disclosed applications.

TECHNICAL FIELD

The present invention relates to a dispersion apparatus for use with smelting technology and related processes. In one aspect, the present invention relates to a dispersion apparatus for use with a concentrate burner or a solid fuel burner. In another aspect, a dispersion lance for use with smelting technology and related processes is disclosed.

The present application claims priority to Australian provisional patent application No 2013904005, the content of which is incorporated herein.

BACKGROUND

Effective flash smelting of ore concentrates requires smelting combustion reactions to be carried out as efficiently as possible. A flash smelting furnace typically includes an elevated reaction shaft at the top of which is positioned a burner where particulate feed material and reaction gas are brought together. In the case of copper smelting, the feed material is typically an ore concentrate containing copper and iron sulphide minerals. The concentrate is usually mixed with a silica flux and combusted with pre-heated air or oxygen-enriched air. Molten droplets are formed in the reaction shaft and fall to the settler, forming a copper-rich matte and an iron-rich slag phase.

A conventional burner includes an outer windbox plenum, a water-cooled sleeve, a velocity adjustment cone, and an internal solid fuel injection lance. The burner typically contains a cooling block that is attached to the windbox plenum and integrates with the roof of the furnace reaction shaft.

The lower portion of the adjustment cone and the inner edge of the cooling block create an annular channel. Oxygen enriched combustion air enters the windbox and is discharged to the reaction shaft through the annular channel. The water-cooled sleeve and the internal injection lance create an annular channel within the combustion air flow annulus.

The feed material is introduced from above and descends through the injector sleeve into the reaction shaft inside an internal annulus. Deflection of the feed material into the reaction gas is promoted by a bell-shaped tip at the lower end of the central lance. In addition, the tip includes multiple perforation jets that direct compressed air outwardly to disperse the feed material in an umbrella-shaped reaction zone.

The material feed supply equipment is typically comprised of bins and hoppers, feeders, (e.g., drag-chains, screw conveyors, air slides, vibratory feeders, pneumatic conveyors, etc.), splitter boxes, manifold connectors, and feed pipes located above the injector. Some feed systems combine feed streams of different particle density, shape, and size upstream of the burner.

Known feed systems of this type are associated with disadvantages that can adversely affect the burner performance and cause inefficiencies, such as for example, variable furnace metallurgy and matte grade, poor oxygen utilisation, and increased elutriation of dust to the off-gas handling equipment, etc.

An example of a typical feed problem faced by concentrate burners is poor distribution of feed around the entire circumference of the burner feed outlet. Feed systems usually contain one or more feed chutes that interface with the injector and attempt to utilize splitter boxes and diverter chutes to distribute feed evenly around the circumference. Such systems tend to cause the feed to gather at corners/edges of the chute walls and fins, forming dense "ropes" of feed within the plume, resulting in poor combustion and reduced oxygen efficiency.

Pneumatic conveying systems have been proposed in an attempt to resolve pulsation problems, but require a large investment of capital for new equipment, as well as substantial modifications to existing building layouts to accommodate such systems. These systems, however, do not appear to have improved combustion efficiencies of sufficient order because they feed through intermediate feed chutes, splitters or other equipment which appear to disrupt the particle distribution, and feed through discrete inlet points around the circumference of the burner.

In the burning of other particulate fuels, such as coal burning applications, attempts have been made to achieve the particle distribution with the use of mechanical and rotating machinery. Complex arrangements that extrude pulverized coal into combustion chambers have been investigated in an attempt to eliminate feed pulsations. U.S. Pat. No. 4,803,836 described a typical example of such a device. The same operational problems inherently affect the combustion stability and operation of flash smelters and concentrate combustion reactors.

In this specification, where a literary work, act or item of knowledge (or combinations thereof), is discussed, such reference is not an acknowledgment or admission that any of the information referred to formed part of the common general knowledge as at the priority date of the application. Such information is included only for the purposes of providing context for facilitating an understanding of the inventive concept and the various forms in which it takes.

SUMMARY OF THE INVENTION

According to a first principal aspect of the present invention, there is provided a dispersion apparatus for use with a solid fuel burner, the apparatus comprising:

a passage through which particulate material may flow toward an outlet region for dispersal therefrom, the flow being at least in part, rotational about a longitudinal axis of the passage, and a downstream guide means arranged within the passage at or near the outlet region, the downstream guide means configured to at least reduce the rotational motion so that the flow progresses toward the outlet region in a substantially uniform manner in a direction aligned with the longitudinal axis of the passage.

The general path of travel or flow of the particles through the passage is in a direction aligned with the longitudinal direction of the passage. By this, the skilled reader will understand that the path of travel or flow of the particles through the passage is toward the outlet region. Movement of the particles through the passage is, in most embodiments, due to the influence of gravity.

The particulate material (hereinafter, particles) is generally provided in the form of small solid particles introduced into the passage by way of a feed means such as for example a feed chute arranged upstream of the downstream guide means and the outlet region. The passage therefore serves as a conduit through which the particles travel or flow toward the outlet region for dispersal therefrom.

Embodiments of the downstream guide means serve to modify and/or straighten the direction of travel of the particles prior to dispersion from the outlet region. That is, the downstream guide means seeks to, at least in part, reduce or remove any non-linear component of motion (such as angular or rotational motion) which might be present in the flow of the particles. To this end, the downstream guides means serves to, at least in part, condition the flow of the particles so that they progress in a substantially linear manner toward the outlet region.

The longitudinal axis of the passage may be aligned substantially with the vertical axis, with the outlet region positioned substantially lowermost, and the inlet region positioned substantially uppermost (or upstream and distal of the outlet region) of the passage. Thus, as noted, particles travelling through the dispersion apparatus are motivated there through by way of gravity. It will be understood that embodiments could be realised whereby movement of the particles is achieved by other means, such as for example, gas flow.

The passage may be linear or curvilinear in nature.

In one embodiment, the downstream guide means is arranged so as to be substantially static or stationary relative to the passage.

In one embodiment, the dispersion apparatus further comprises an upstream guide means provided upstream of the downstream guide means and configured for introducing into the flow a component of angular or rotational motion for moving the particulate material about the longitudinal axis of the passage.

Embodiments of the downstream guide means may serve to provide a formation which engages with the passing flow and upon which the particles may impact for provoking the particles to scatter. This scattering behaviour has been found in testing to increase the probability of inter-particle collisions which reduce or remove the angular or rotational motion component which is established by the upstream guide means or otherwise present. As such, the downstream guide means may be configured or shaped to reduce the angular or rotational motion of the particles about the longitudinal axis of the passage, so as to encourage the particles to travel in a manner which is substantially more aligned with the longitudinal axis of the passage. It is considered that the conditioning of the flow into a substantially linear manner further assists in improving the uniformity of the spatial distribution of the particles at or near the outlet region.

In one embodiment, the scattering behaviour provoked or facilitated by the inclusion of the downstream guide means also serves to, at least in part, increase the radial distribution of the particles within the passage as they move toward the outlet region.

In another embodiment, the downstream guide means is configured to at least reduce the rotational motion by increasing the radial distribution of the particles so that the flow progresses toward the outlet region in a substantially uniform manner in a direction aligned with the longitudinal axis of the passage.

In another embodiment, the downstream guide means seeks to, at least in part, reduce the angular or rotational movement of the particles within the passage and, where possible, introduce a component of radial movement into the flow of the particles.

For the majority of the embodiments considered or described herein, the upstream guide means is configured so as to introduce a component of angular or rotational motion (having an angular velocity) to the flow of particles (or movement in a circumferential direction relative to the longitudinal axis of the passage) as they move or flow along the passage toward the outlet region.

The component of angular or rotational motion (which will be understood to include circular like motion about the longitudinal axis of the passage) imparted by the upstream guide means serves to, at least in part, move the particles circumferentially about the general direction of travel (or about the longitudinal axis of the passage) as they move toward the outlet region. The combined action of the upstream guide and the inertia of the particles facilitates their travel so that they travel along a path which complies substantially with the periphery of the passage—the particles being restrained by the interior wall of, for example, a shroud member or an annular channel in which the dispersion apparatus is installed within.

The skilled person will appreciate that some feed arrangements will not introduce the particulate material into the passage in a symmetrical (in orientation and speed/velocity) manner, thereby causing the particles to follow different trajectories within the passage (albeit in the general downstream direction) and making it difficult to reliably condition the particles into a substantially uniform stream. Thus, the centripetal motion imparted by the upstream guide means encourages the particles into a more predictable arrangement for subsequent conditioning. Once the particles are arranged in a more predictable arrangement, additional conditioning can be employed to further assist in increasing the degree of spatial uniformity between the particles as they exit from the outlet region.

Without being bound by preliminary analyses, the inventors have identified that the introduction to the particle flow of an angular or rotational component of motion followed by subsequent conditioning of the flow as described herein, at least in part, improves the uniformity of the spatial distribution of the particles at, near, or about the outlet region. In the context of flash smelting in which solid particulate fuel particles are dispersed into a combustion chamber through the outlet region, a uniform spatial particle distribution has been shown to improve the efficiency of subsequent combustion reactions.

It follows that embodiments of the present invention may serve to provide a substantially uniform spatial distribution of particles (such as solid fuel particles) for injection into combustion chambers at variable feed rates. In some arrangements, embodiments of the dispersion apparatus described herein may find favourable application in the fields of flash smelting of copper, lead or nickel concentrates, flash converting of sulphide mattes or other like fields where spatial uniformity of feed flow is considered advantageous. It will be appreciated that embodiments of the dispersion apparatus or the upstream/downstream guide means described herein could be adapted for use in other fields using or relying on particulate feed systems, such as for example the pharmaceutical, chemical and food production and processing industries.

In one embodiment, the upstream guide means comprises an inlet configured so as to introduce the particulate material into the passage in a direction tangential thereto. In this manner, it will be understood that injection of the particulates, so as to establish a flow of stream of particles, into the passage at an angle that is tangential to the passage, assists in developing a flow about the longitudinal axis of the passage. In some arrangements, injection of the particles in this manner may be assisted by way of conveying gases and the like. In other arrangements, an inlet feed chute could be configured so as to introduce the particles tangentially at an angle to the passage that is sufficient to benefit from the influence of gravity.

It will be appreciated that the upstream guide means may comprise any device, arrangement, mechanism or process capable of introducing an angular or rotational component of motion to the particles which allows the particles to move or flow about their normal course of travel as they move or flow through the passage toward the outlet region. The skilled person would realise that other arrangements could be developed which rely on alternative means for imparting angular or rotational motion to the particles, such as for example, the use of conveying or background gases injected tangentially into the passage.

In one embodiment, the upstream guide means may comprise an inlet angled relative to the passage so as to introduce the particles into the passage in a substantially tangential manner. In one arrangement, the inlet extends into the passage.

In one embodiment, the upstream guide means comprises a guide element having a longitudinal axis which is aligned substantially concentric with that of the passage. In such embodiments, the guide element is arranged to be stationary or static relative to the passage.

The guide element may comprise one or more shaped features each comprising a surface defined between a three dimensional curve wound substantially uniformly about and along (length dimension) a portion of the longitudinal axis of the guide element at a distance radially outward therefrom (width dimension), and a point on or near said axis. It will be appreciated that the width dimension defines the outermost edge or peripheral edge of each shaped feature from the axis, and which may be uniform along its length. Alternatively, the width of the or each shaped feature could be non-uniform in nature.

In one embodiment, the surface of the or each shaped feature is configured so as to be aligned substantially orthogonal or perpendicular to the longitudinal axis of the guide element. In this manner, the skilled person will understand that the angle the surface makes (in the radial direction relative to the longitudinal axis of the guide element) to the longitudinal axis of the guide element is about 90 degrees. It will be appreciated, however, that the surface of the or each shaped feature may be orientated at different angles relative to the longitudinal axis of the passage or the guide element depending on the situation and application.

In one embodiment, the or each shaped feature comprises a spiral (such as for example a spiral vane) wound substantially uniformly about a portion of the longitudinal axis of the guide element. In this arrangement, each spiral vane provides, in effect, a spiral ramp of uniform or varying width as required.

In some arrangements, a surface of the spiral extending in the radial direction relative to the direction of the longitudinal axis of the guide element is configured so as to be aligned substantially orthogonal or perpendicular to the longitudinal axis of the guide element. In this manner, it will be understood that the surface of the spiral is substantially square (or at about 90 degrees) relative to the longitudinal axis of the passage or the guide element. It will be appreciated, however, that the surface of the spiral may be orientated at different angles relative to the longitudinal axis of the passage or the guide element depending on the situation and application.

In another embodiment, the or each shaped feature comprises a helicoid (or 'filled-in' spiral ramp) configured so as to extend about and along a portion of the longitudinal axis of the guide element. The or each helicoid may be of uniform or non-uniform radius. In some arrangements, a surface of the helicoid is arranged in substantially the same manner as the surface of the spiral.

It will be understood that the sloping surface or 'ramp' of the or each shaped feature is measured by its pitch, which is the length of the feature when measured parallel to its axis. It will be understood that the pitch of the or each shaped feature is commensurate with the degree of angular or rotational motion imparted to the particles as they encounter or flow along said feature.

As noted, particles travelling through the dispersion apparatus are motivated there through by way of gravity. It will be understood that embodiments could be realised whereby movement of the particles is achieved by other means, such as for example, gas flow. For example, a small amount of background gas could be used to assist the particles travelling along one or more of the shaped features. In one embodiment, the background gas could comprise air being driven by a pressure differential between the inside of an associated furnace and the outside or ambient atmosphere.

In some embodiments, the pitch of each shaped feature is uniform across/along its length. However, the pitch of each shaped feature can be non-uniform across/along its length so to allow the angular or rotational velocity component imparted to the particles to be varied along certain regions of the guide element.

There is no finite number of times that a shaped feature needs to wind about its axis (or that of the guide element)—only sufficient length is required so that the particles are encouraged toward the periphery of the passage (or so they reach the interior surface of a shroud member for example). It will be appreciated that the length of each shaped feature and its pitch will generally depend on how easily the particulate material flows. A balance is therefore sought between the velocity of the particles and the type of material concerned, ie. if the particles are traveling too slow, then the particles may be (a), less likely to reach the periphery of the passage, and (b), blockages may occur. The velocity of the particles is therefore, at least in part, controlled by the number of shaped features, and their pitch. For example, for the case of particulate matter which flows more readily, a flatter pitch with fewer spirals may be more preferable. If the particulate matter does not flow as readily, a steeper pitch (so as to increase the particle velocity when moving under the influence of gravity) and a larger number of shaped features may be more desirable so as to encourage the material toward the periphery of the passage.

In another embodiment, the upstream guide means comprises a spiral arranged within the passage and configured so as to extend along at least a portion of the passage.

In one arrangement, the upstream guide means is arranged so as to be substantially static or stationary relative to the passage.

In another embodiment, the spiral comprises a sidewall portion provided at or near a peripheral edge region of the spiral and arranged for preventing the particulate material travelling beyond the periphery of the passage at or near said peripheral edge region, the sidewall portion arranged so as to extend along at least a portion of the peripheral edge region. In this manner, the sidewall portion serves as an edge barrier for constraining further radial movement of the particles as they move about the longitudinal axis of the passage. Thus, it will be understood that the sidewall portion, where ever provided, seeks to prevent the particles from moving beyond the extremities of the passage (where the sidewall is provided) and further assists in establishing the generally angular or rotational particle flow through the passage.

It will be appreciated that such a sidewall portion may be provided on one or more shaped features described above.

In another embodiment, the dispersion apparatus comprises a column member configured so as to extend toward the outlet region and about which the guide element is arranged. The column member may be configured so as to provide support for the guide element.

In one embodiment, the longitudinal axis of the guide element is concentric with the longitudinal axis of the column member.

The configuration of the guide element relative to the column member may be arranged so that the pitch of the or each shaped features can be altered while in use, thereby allowing the rotational component of motion of the particles (such as for example, angular velocity) to be varied if necessitated by operational requirements. It will be understood that the pitch could be changed prior to use, or arrangements could be realised which incorporate technology which allows the pitch to be varied during use.

The shaped features may be configured so as to be continuous or discontinuous along their length.

The dispersion apparatus may further comprise an inlet region upstream of the upstream means or guide element and arranged so as to be in fluid communication with one or more feed chutes configured for introducing particulate material into the passage.

In one embodiment, the inlet region may comprise a manifold arrangement which serves to direct particles received from the or each feed chute toward the guide element. In one embodiment, the manifold arrangement is configured so as to divide incoming particulate matter into a number of separate streams of flow, the configuration being such that each stream of flow is directed toward a respective shaped feature.

In one embodiment, for the case of a single or dual feed chute arrangement, the manifold arrangement is arranged to divide the incoming particle flow into four streams, each stream being directed toward a respective shaped features, such as for example a spiral or helicoid (ie. an embodiment of the guide element having four shaped features provided in the form of a spiral or a helicoid configuration). In such arrangements, one or more of the spiral or helicoid structures may extend sufficiently toward the manifold arrangement so as to be capable of receiving the particulate so directed.

In various embodiments, the manifold arrangement or feed chute may be configured so that the particulate material is introduced or injected into the passage at an angle substantially tangential to the passage.

In one embodiment, the extension of a spiral or helicoid structure is such that a substantially smooth transition is provided to the respective spiral or helicoid. Alternatively, the extension may be configured such that the transition is substantially abrupt.

It will be appreciated that numerous arrangements for feeding particulate solids into the dispersion apparatus of the principal aspects described herein by way of one or more inlet regions will be known to the skilled reader, any of which could be readily adaptable for use with most embodiments of the present invention described herein.

The column member may extend from at or near the inlet region and terminate at or near the outlet region of the passage.

The or each shaped features of the guide element may extend along all or a portion of the column member.

In some arrangements, the or each shaped features of the guide element may extend from at or near the inlet region of the apparatus and terminate at or near the outlet region.

The column member may be provided in the form of a tubular elongate member of substantially uniform cross section. In such an embodiment, the column member may be configured for allowing a gas to flow through a hollow region of the tubular region. In one arrangement, the gas is arranged to flow in a direction toward the outlet region of the apparatus.

The column member may comprise regions thereof having variable cross section.

Alternatively, the column member may be a solid elongate member of substantially uniform cross section.

The column member may be configured to remain substantially stationary relative to the moving particles.

In another embodiment, the guide element and the column member are arranged so as to be substantially static or stationary relative one another. In such arrangements, the guide element may be arranged so as to be fixedly attached to the column member.

Alternatively, the guide element may be configured so as to be releasably attachable to the column member so that both may be separable for, for example, maintenance purposes. Moreover, the guide element may be removable so that it can be reconfigured so as to allow the pitch of the shaped feature(s) to be altered. Such alteration may be achievable by compressing or extending the length of the guide element thereby changing the pitch as desired.

The guide element may be formed so as to be integral with the column member. By this, both the column member and guide element may be manufactured or formed from the same material together so as to exploit the efficiencies of known moulding/forming manufacturing techniques. Moreover, although both may be formed of separate materials, they may be provided together so as to act as a single component part.

Alternatively, the guide element may be a separate component which can be assembled with the column member. In one such arrangement, the guide element may comprise a tubular portion which is configured to be engageable with the column member such that both can be aligned relative one another appropriately. The tubular portion of the guide element may be configured so as to receive the column member therein, and manipulated such that the guide element can be positioned at the appropriate location along the length of the column member.

The skilled person will be aware of materials and manufacturing techniques which can be used to construct and assemble the majority of the components described herein.

In another embodiment, the dispersion apparatus further comprises a shroud member which is configured to define at least a portion of the passage.

In one arrangement, the shroud member serves to provide a barrier for preventing the particulate material from moving beyond the periphery of the passage.

The shroud member may be provided in the form of, for example, an elongate circular tube. In one arrangement, the longitudinal axis of the passage and the elongate tube are arranged concentric one another.

The shroud member may be of uniform or non-uniform cross section.

The shroud member may be tapered along its longitudinal axis.

In one embodiment, the shroud member or circular tube surrounds a portion of the upstream or downstream guide means. In such arrangements, it will be understood that the shroud serves to ensure that the particles remain within the passage when travelling through the portion of the passage accommodating the upstream or downstream guide means surrounded by the shroud member. Thus, it will be understood that the shroud member serves to provide a barrier for substantially preventing the particles from moving beyond the periphery of the passage.

In one embodiment, the passage is defined, at least in part, by an interior surface of an annular channel in which embodiments of the dispersion apparatus is installed.

In some embodiments, the annular channel may be part of an associated concentrate burner or solid fuel burner in which embodiments of the dispersion apparatus or dispersion lance described herein is installed therein.

The shroud member may be provided in the form of a cylindrical tube. In one embodiment, the shroud member, when assembled with the column member, serves to define, a portion of the passage through which the particles travel. Furthermore, the shroud member and the column member may define, at least in part, an annular orifice at or near the outlet region through which particles are dispersed therefrom.

In another embodiment, the guide element is attached or mounted to an interior surface or wall of the shroud member. In this arrangement, when assembled, the shroud member is placed about or substantially concentric with the column member so that the guide element resides proximal with the column member. In such arrangements, the guide element may be formed as an integral part of the shroud member in a manner similar to that noted above.

In a further embodiment, the downstream guide means comprises one or more protrusions arranged about the longitudinal axis of the passage, the or each protrusion configured so as to engage with the passing flow of particulate material.

In another embodiment, the downstream guide means comprises one or more annular rings arranged concentric with the passage and configured so as to engage with the passing flow of particulate material.

In another embodiment, the downstream guide means comprises a plurality of elongate elements spaced about the passage at or near its periphery and configured so as to engage with the passing flow of particulate material, each elongate element having an elongate direction which is aligned with the longitudinal axis of the passage.

In one embodiment, the downstream guide means is provided in the form of one or more protrusions arranged about, and aligned with, the longitudinal axis of the passage and configured for engaging the passing flow. The protrusions may comprise one or more elongate ribs or vanes axially aligned substantially with the longitudinal axis of the passage, and spaced regularly or about the circumference of the passage. The elongate ribs may have a rectangular cross section extending uniformly along their length. The or each elongate rib comprises an elongate axis which aligns with its longitudinal axis. It will be appreciated that the cross section of the elongate ribs could be of any shape appropriate for engaging with the passing flow of particulates.

In another embodiment, the protrusions comprise a plurality of elongate members spaced about at or near the periphery of the passage so as to engage the passing flow for reducing movement of the particles about the direction of travel and/or provoke radial movement within the passage prior to dispersion from the outlet region. In this arrangement, the elongate direction of the members is aligned substantially with the longitudinal direction of the passage.

It will be appreciated that any formation provided intermediate the upstream guide means and the outlet region which serves to straighten the path of travel of the particles (ie. reducing or removing the angular or rotational component of motion of the particles), or promote particle scatter, may have utility with embodiments of the presently described aspect of the invention.

For example, in alternative arrangements, the inventors consider that the downstream guide means may be provided in the form of at least one or more cylindrical lugs, hemispherical lugs, or wedges, nozzle rings, or circumferentially spaced ribs provided within the path of travel of the particles. It is considered that such formations serve to provoke particle scatter so as to promote inter-particle collisions (ie. reducing or removing the angular or rotational component of motion and/or increasing radial movement within the passage). In some embodiments, such formations provoke the particles to converge and diverge from one another serving to, at least in part, provoke inter-particle collisions which can improve spatial/radial distribution between the particles downstream.

In another embodiment, the downstream guide means may be provided in the form of an annular ring orientated substantially concentric with the longitudinal axis of the passage (or shroud member). The annular ring may be shaped so as to provide a surface upon which the particles may impact, so provoking particle scatter. The annular ring may be attached to the interior wall of the shroud at or near its downstream free end. The annular ring may be of substantially uniform cross section.

One or more annular rings may be provided at various locations within a shroud member down stream of the upstream guide means.

The or each annular ring may be arranged so as to project a portion thereof sufficiently inwardly of the passage so as to intrude upon, interfere or engage with the passing flow of particles.

It will be appreciated that the downstream guide means may comprise a combination of any of the above features so as to condition the flow of the particles sufficiently downstream of the upstream guide means.

Formations of the downstream guide means may be constructed or formed from various known manufacturing techniques, and materials known to the skilled person.

The downstream guide means (and any of its possible forms described herein) may be mounted to an interior surface or wall of the shroud member. Alternatively, the downstream guide means could be mounted to the upstream guide means, or the column member. It will be appreciated that in any of these arrangements the mounting could be releasable in nature such as for, for example, maintenance purposes and the like.

It will be appreciated that any of the embodiments of the dispersion apparatus described above may be arranged for use with a concentrate burner or solid fuel burner.

Any of the features described above in relation to the first principal aspect may be incorporated with any of the embodiments of the principal aspects described below. Similarly, any of the features described in relation to the further principal aspects described below may be incorporated and/or adapted for use with any of the embodiments described in relation to the first principal aspect described above.

According to a second principal aspect of the invention, there is provided a dispersion apparatus for use in conditioning the flow of a particulate material flowing therethrough, the apparatus comprising:

a passage through which particulate material may flow toward an outlet region for dispersal therefrom, the flow being at least in part, rotational about a longitudinal axis of the passage, and a downstream guide means arranged within the passage at or near the outlet region, the downstream guide means configured to at least reduce the rotational motion so that the flow progresses toward the outlet region in a substantially uniform manner in a direction aligned with the longitudinal axis of the passage.

In one embodiment, the downstream guide means is configured in accordance with any of the embodiments of the downstream guide means as described above.

In another embodiment, the dispersion apparatus further comprises an upstream guide means provided upstream of the downstream guide means and configured for introducing into the flow a component of angular or rotational motion for moving the particulate material about the longitudinal axis of the passage.

In a further embodiment, the upstream guide means is configured in accordance with any of the embodiments of the upstream guide means as described above.

In a further embodiment, the dispersion apparatus further comprises a shroud member which is configured to define at least a portion of the passage. In one arrangement, the shroud member surrounds a portion of the upstream or downstream guide means.

In another embodiment, the passage is defined, at least in part, by an interior surface of an annular channel in which the dispersion apparatus is installed.

It will be appreciated that any of the embodiments of the dispersion apparatus described above in relation to the second principal aspect may be arranged for use with a concentrate burner or solid fuel burner.

According to a third principal aspect of the present invention, there is provided a dispersion apparatus for use in conditioning the flow of a particulate material flowing therethrough, the apparatus comprising:

a passage through which particulate material may flow toward an outlet region for dispersal therefrom, an upstream guide means configured for introducing into the flow a component of angular or rotational motion for moving the particulate material about a longitudinal axis of the passage, and a downstream guide means arranged within the passage at or near the outlet region and downstream of the upstream guide means, the downstream guide means configured to at least reduce the angular or rotational motion so that the flow progresses toward the outlet region in a substantially uniform manner in a direction aligned with the longitudinal axis of the passage.

In one embodiment, the upstream guide means comprises an inlet configured so as to introduce the particulate material into the passage in a direction tangential thereto.

In one embodiment, the upstream guide means may comprise an inlet angled relative to the passage so as introduce the particles into the passage in a tangential manner. In one arrangement, the inlet extends into the passage.

In another embodiment, the upstream guide means comprises a spiral arranged within the passage and configured so as to extend along at least a portion of the passage.

In one embodiment, the spiral comprises a sidewall portion provided at or near a peripheral edge region of the spiral and arranged for preventing the particulate material travelling beyond the periphery of the passage at or near the peripheral edge region, the sidewall portion arranged so as to extend along at least a portion of the peripheral edge region.

In another embodiment, the downstream guide means comprises a plurality of elongate elements spaced about the passage at or near its periphery and configured so as to engage with the passing flow of particulate material, each elongate element having an elongate direction which is aligned with the longitudinal axis of the passage.

In a further embodiment, the upstream guide means is configured in accordance with any of the embodiments of the upstream guide means as described above.

In a further embodiment, the downstream guide means is configured in accordance with any of the embodiments of the downstream guide means as described above.

In a further embodiment, the dispersion apparatus further comprises a shroud member which is configured to define at least a portion of the passage. In one arrangement, the shroud member surrounds a portion of the upstream or downstream guide means.

In another embodiment, the passage is defined, at least in part, by an interior surface of an annular channel in which the dispersion apparatus is installed.

It will be appreciated that any of the embodiments of the dispersion apparatus described above in relation to the third principal aspect may be arranged for use with a concentrate burner or a solid fuel burner.

According to a fourth principal aspect, there is provided a dispersion lance for use in dispersing particulate material, the dispersion lance being arranged in accordance with any of the embodiments of the dispersion apparatus described herein.

It will be appreciated that any of the embodiments of the dispersion lance of the fourth principal aspect may be arranged for use with a concentrate burner or solid fuel burner.

According to a fifth principal aspect, there is provided a method for modifying the path of travel of particulate material flowing through a passage of a dispersion apparatus or dispersion lance from which the particulate material is to be dispersed from, the method comprising:

modifying the path of flow of the particulate material at or near an outlet region of the dispersion apparatus or dispersion lance to at least reduce any rotational motion of the flow about a longitudinal axis of the passage so that the flow progresses toward the outlet region in a substantially uniform manner in a direction aligned with the longitudinal axis of the passage.

In one embodiment, the method further comprises:

introducing into the flow of particulate material at a region of the passage upstream and distal of the outlet region, a component of angular or rotational motion for moving the particulate material about the longitudinal axis of the passage.

In another embodiment, introducing the component of angular or rotational motion into the flow comprises introducing the particulate material into the passage in a direction tangential thereto.

In one embodiment, introducing the particulate material into the passage in a direction tangential thereto is achieved by way of an inlet angled relative to the passage so as introduce the particles into the passage in a tangential manner. In one arrangement, the inlet extends into the passage.

In one embodiment, introducing the component of angular or rotational motion into the flow comprises providing an upstream guide means configured so as to extend along at least a portion of the passage.

Embodiments of the upstream guide means may be arranged in accordance with any of the embodiments of the upstream guide means described above.

In a further embodiment, introducing the component of angular or rotational motion into the flow comprises providing a spiral within the passage and which is configured so as to extend along at least a portion of the passage.

In another embodiment, modifying the path of flow of the particulate material at or near the outlet region comprises providing a downstream guide means within the passage at or near the outlet region, the downstream guide means configured so as to engage with the passing flow of particulate material.

Embodiments of the downstream guide means may be configured on accordance with any of the embodiments of the downstream guide means described above.

In another embodiment, modifying the path of flow of the particulate material at or near the outlet region comprises providing one or more protrusions arranged about the longitudinal axis of the passage, the or each protrusion configured so as to engage with the passing flow of particulate material.

In a further embodiment, modifying the path of flow of the particulate material at or near the outlet region comprises providing a plurality of elongate elements spaced about the passage at or near its periphery and configured so as to engage with the passing flow of particulate material, each elongate element having an elongate direction which is aligned with the longitudinal axis of the passage.

In another embodiment, the dispersion apparatus is configured in accordance with any of the embodiments of the dispersion apparatus described herein.

In a further embodiment, the dispersion lance is configured in accordance with any of the embodiments of the dispersion lance described herein.

For the purposes of summarising the principal aspects of the present invention, certain aspects, advantages and novel features have been described herein above. It is to be understood, however, that not necessarily all such advantages may be achieved in accordance with any particular embodiment or carried out in a manner that achieves or optimises one advantage or group of advantages as taught herein without necessarily achieving other advantages as may be taught or suggested herein.

BRIEF DESCRIPTION OF THE DRAWINGS

In order to facilitate a better understanding of the underlying inventive concept, various embodiments of the invention will now be further explained and illustrated, by way of example only, with reference to any one or more of the accompanying drawings, in which.

In the figures, like elements are referred to by like numerals throughout the views provided. The skilled reader will appreciate that elements in the figures are illustrated for simplicity and clarity and have not necessarily been drawn to scale. For example, the dimensions and/or relative positioning of some of the elements in the figures may be exaggerated relative to other elements to facilitate an understanding of the various embodiments of the invention described herein. Also, common but well understood elements that are useful or necessary in a commercially feasible embodiment are often not depicted in order to provide a less obstructed view of these various embodiments of the present invention. It will also be understood that the terms and expressions used herein adopt the ordinary meaning as is accorded to such terms and expressions with respect to their corresponding respective areas of inquiry and study except where specific meanings have otherwise been set forth herein.

Specifically, reference to positional descriptions, such as 'lower' and 'upper', and associated forms such as 'uppermost' and 'lowermost', are to be taken in context of the embodiments shown in the figures, and are not to be taken as limiting the invention to the literal interpretation of the term, but rather as would be understood by the skilled reader. Furthermore, reference to 'upstream' and 'downstream, and associated forms, are to be taken in context of the embodiments shown in the figures, and are not to be taken as limiting the invention to the literal interpretation of the term, but rather as would be understood by the skilled reader.

DETAILED DESCRIPTION

FIGS. 1 to 11 show a dispersion apparatus for a solid fuel burner designed to deliver a particle stream to a combustion environment in a manner that provides favourable conditions for combustion of the solid particles. A solid fuel burner could include any burner known in the art, for example, a concentrate burner.

Figure 1:
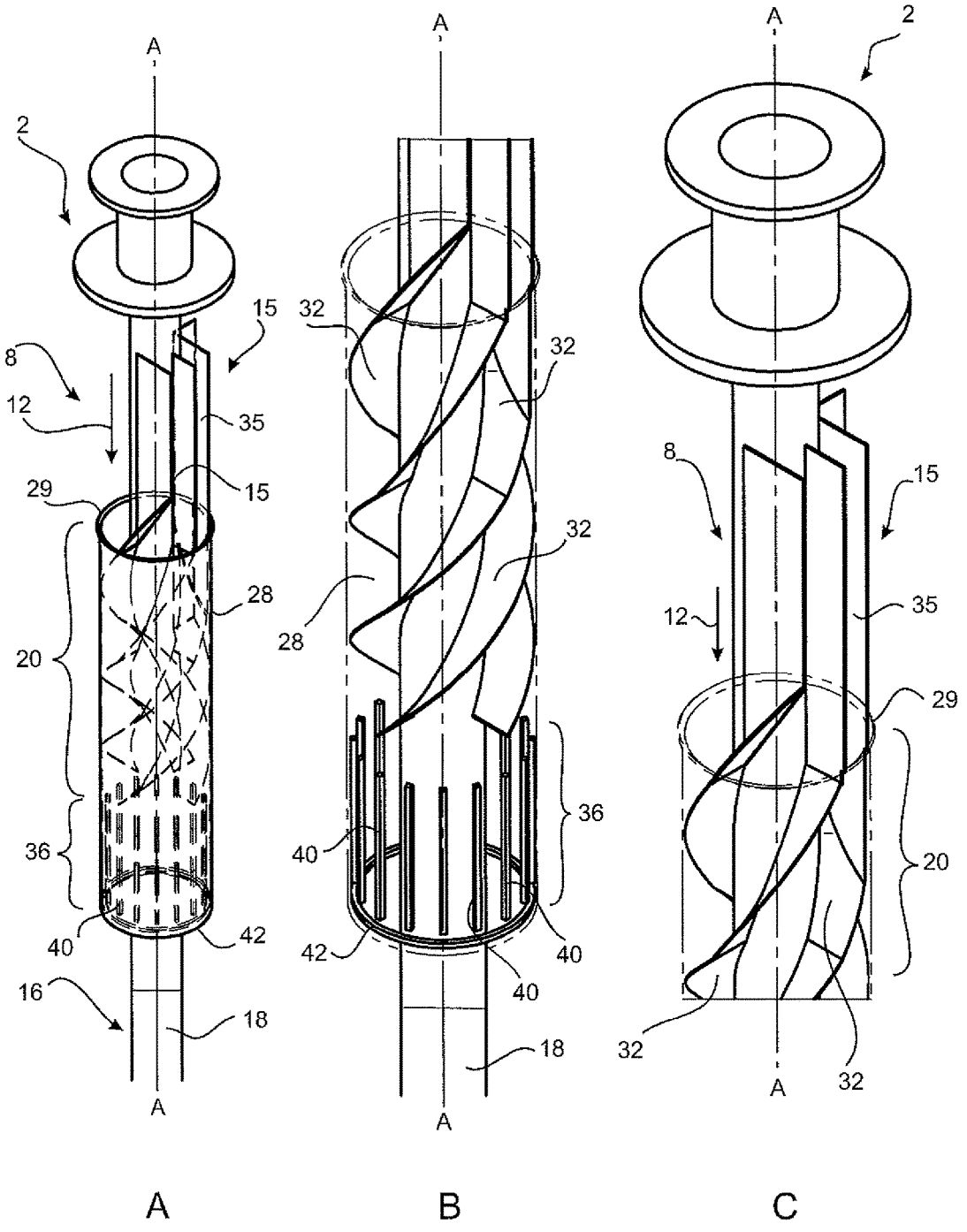
FIG. 1A shows an isometric view of one embodiment of a dispersion apparatus arranged in accordance with the present invention.
FIG. 1B shows an isometric view of the lower portion of the embodiment of the dispersion apparatus shown in FIG. 1A.
FIG. 1C shows an isometric view of the upper portion of the embodiment of the dispersion apparatus shown in FIG. 1A.
Figure 2:
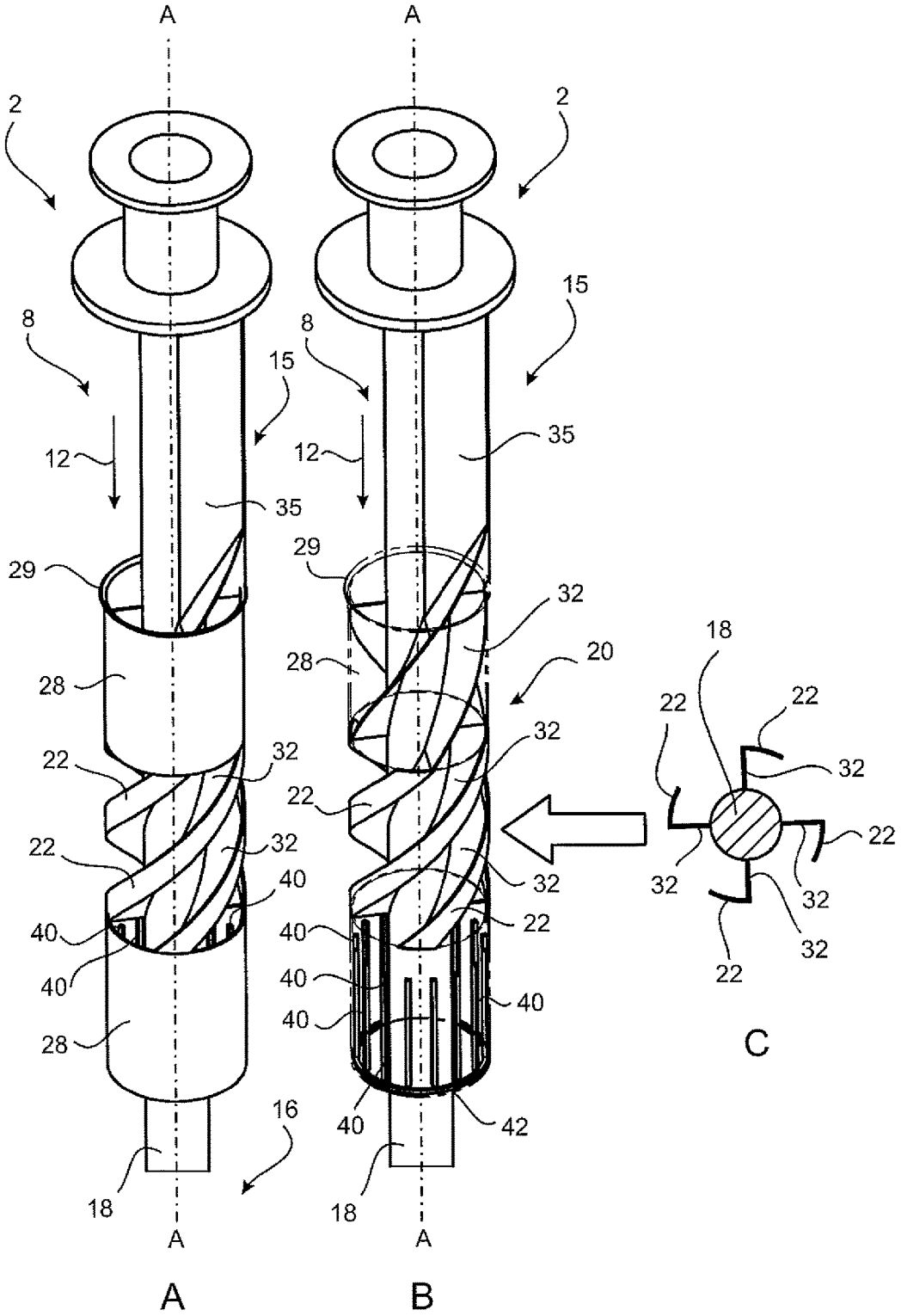
FIG. 2A shows an isometric view of another embodiment of a dispersion apparatus arranged in accordance with the present invention.
FIG. 2B shows an isometric view of embodiment of the dispersion apparatus shown in FIG. 2A, but showing detail otherwise hidden in FIG. 2A.
FIG. 2C shows a schematic cross section of the embodiment shown in FIGS. 2A and 2B taken along the passage at the location generally indicated by the arrow (showing the sidewall portions provided at the peripheral edge of the spiral features)
Figure 3:
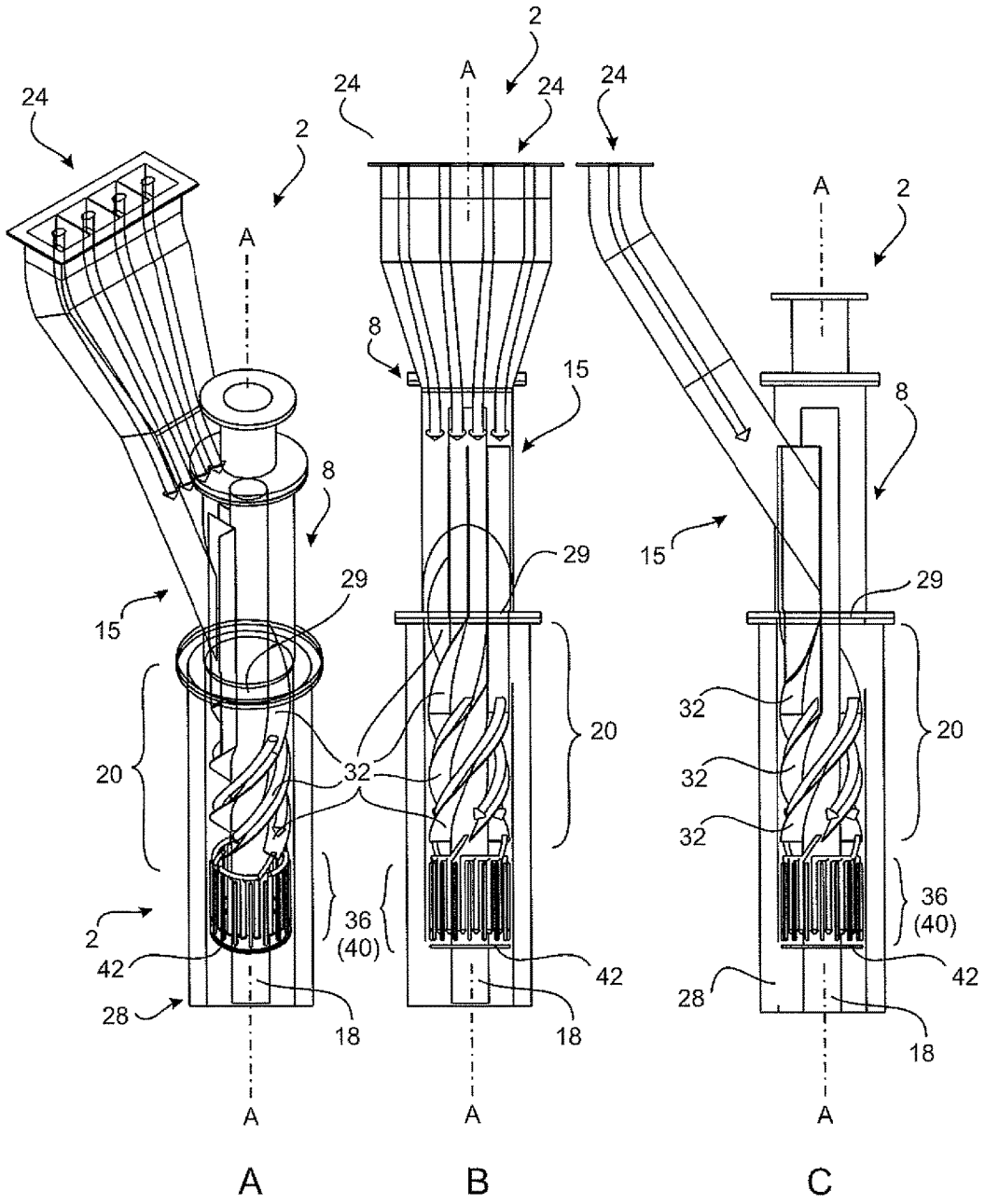
FIG. 3A shows an elevation view of the embodiment of the dispersion apparatus shown in FIGS. 1A to 1C when arranged with a single feed chute (showing particle flow)
FIG. 3B shows an elevation view of the embodiment of the dispersion apparatus shown in FIGS. 1A to 1C when arranged with a dual feed chute arrangement (showing particle flow)
FIG. 3C shows an alternative elevation view of the embodiment of the dispersion apparatus shown in FIG. 3A (showing particle flow)
Figure 4:
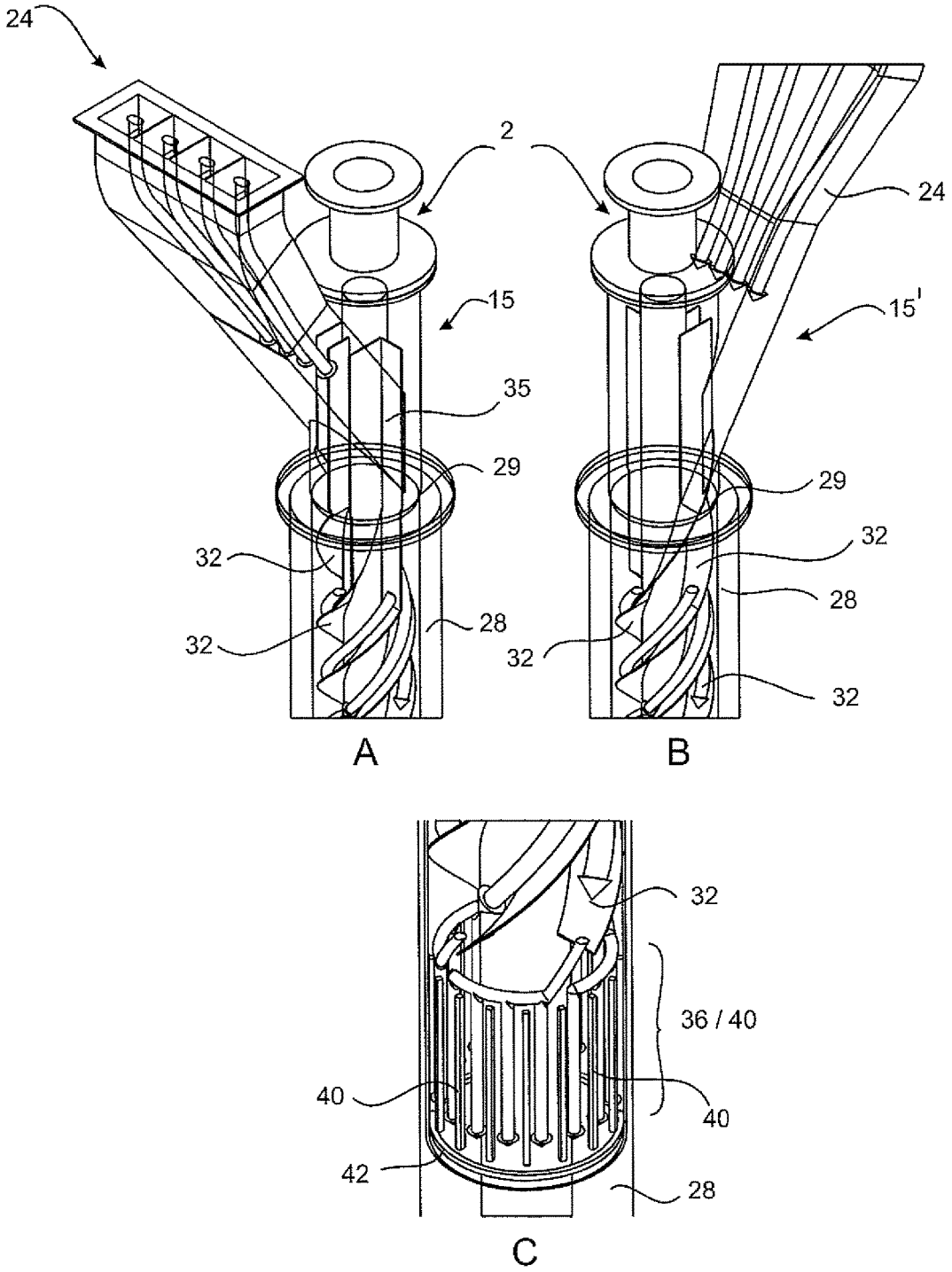
FIG. 4A shows an isometric view of the inlet region for the embodiment of the dispersion apparatus shown in FIGS. 1A to 1C (showing particle flow)
FIG. 4B shows an alternative isometric view (rotated slightly) of the embodiment of the dispersion apparatus shown in FIG. 4A (showing particle flow)
FIG. 4C shows an isometric elevation view of the lower portion of the embodiment of the dispersion apparatus shown in FIG. 4A and FIG. 4B (showing particle flow)
Figure 5:
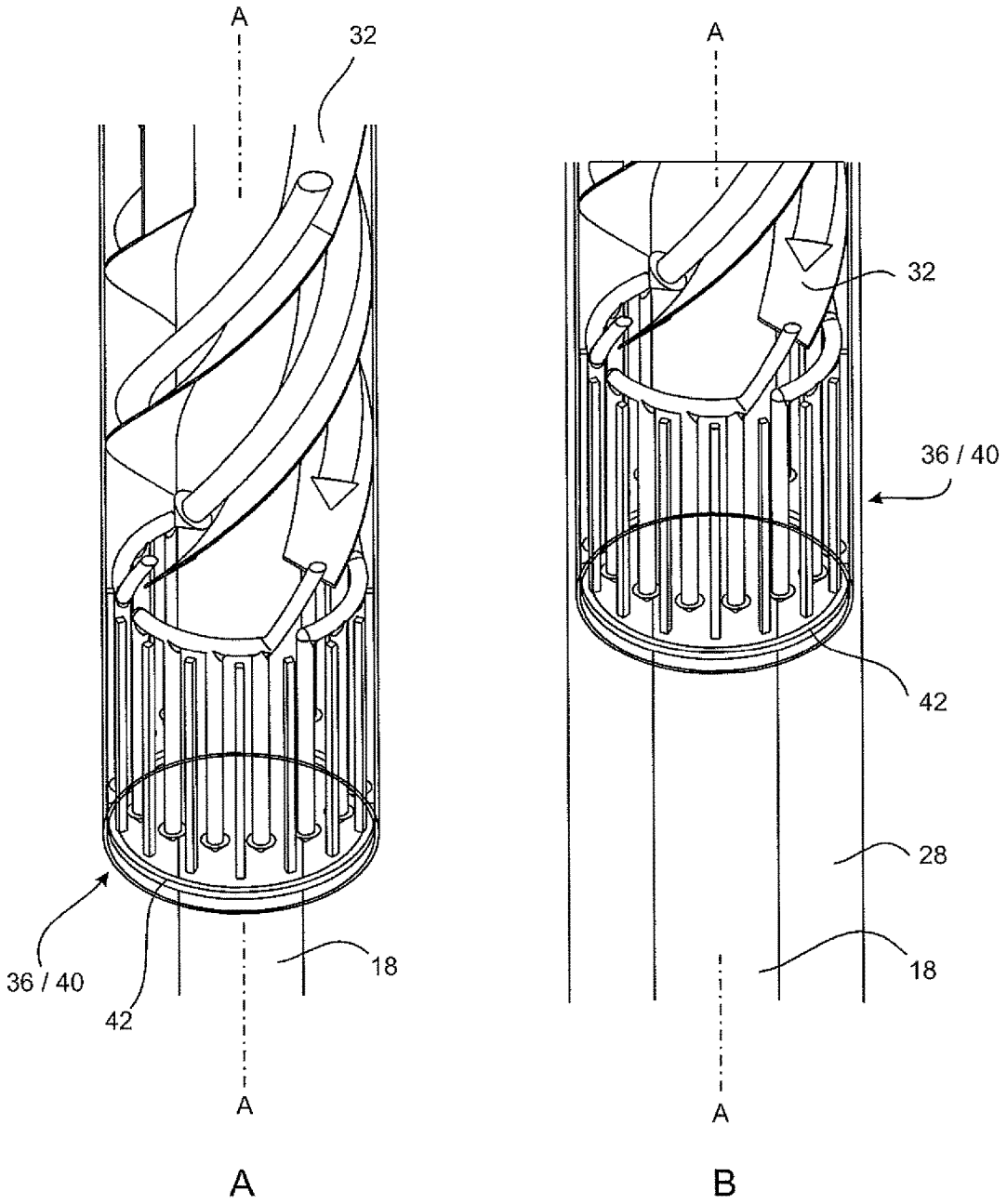
FIG. 5A shows an isometric view of the estimated particle flow pattern around the mid-section of the embodiment of the dispersion apparatus shown in FIGS. 1A to 1C.
FIG. 5B shows an isometric view of the estimated particle flow pattern at the lower section for the embodiment of the dispersion apparatus shown in FIGS. 1A to 1C.
Figure 6:
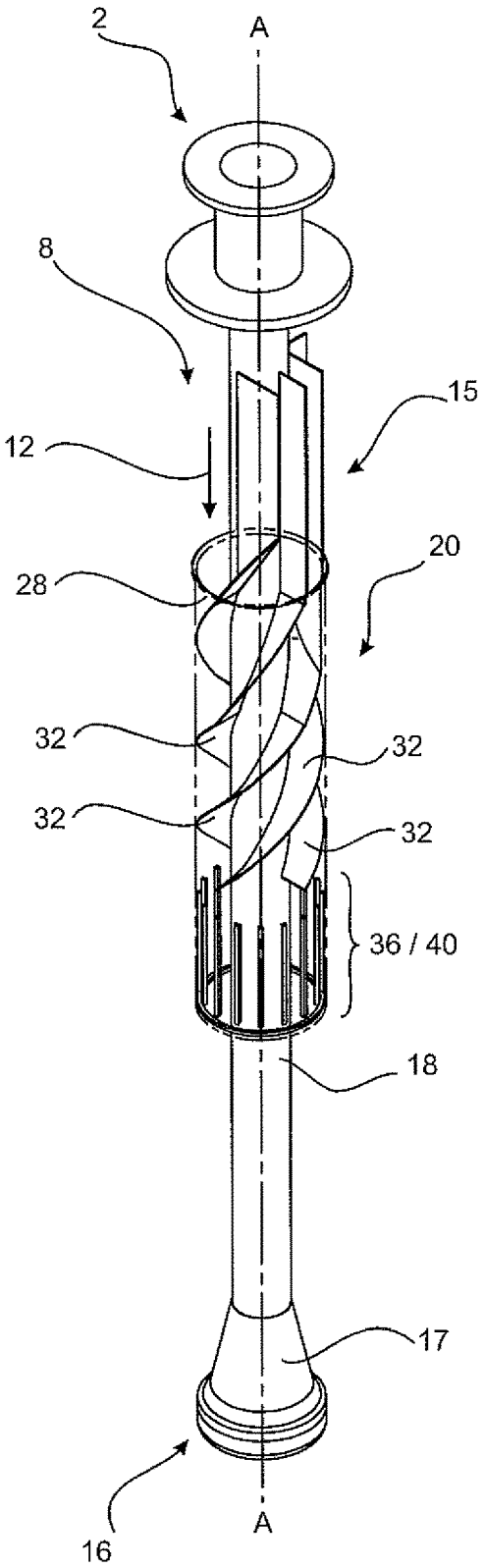
FIG. 6 shows an isometric view of the embodiment of the dispersion apparatus shown in FIGS. 1A to 1C.
Figure 7:
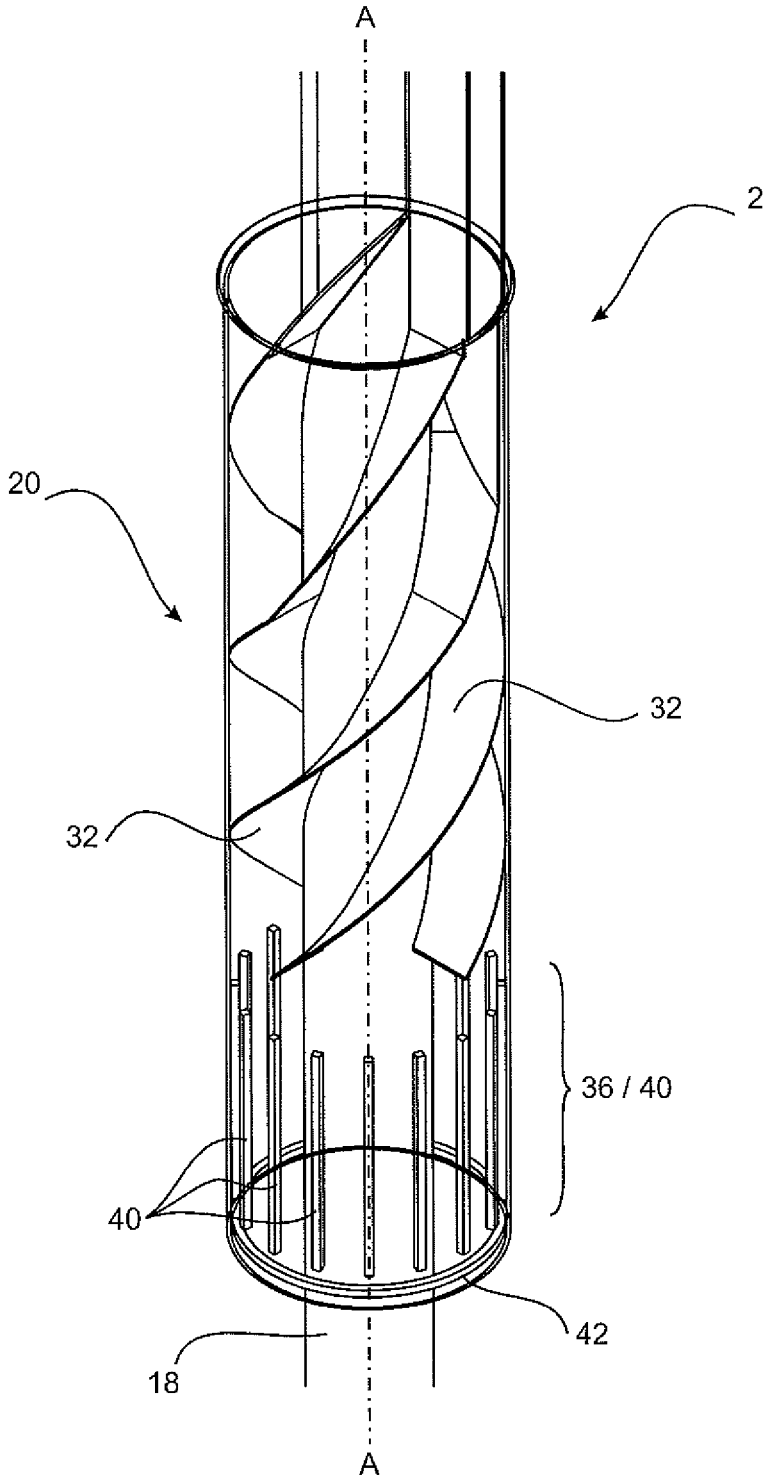
FIG. 7 shows a close up isometric view of the mid-section of the embodiment of the dispersion apparatus shown in FIG. 6.

FIG. 1A through 1C shows one embodiment of a dispersion apparatus (hereinafter, disperser 2)—often referred to as a dispersion or injection lance (refer FIG. 6 and FIG. 7 for corresponding isometric line drawings of the embodiment shown in FIGS. 1A through 1C). The disperser 2 comprises a passage 8 having a longitudinal axis A and through which the particulate material (hereinafter, particles) may travel or flow in a direction 12 toward an outlet region 16 from which the particles are dispersed.

The general path of travel 12 of the particles through the passage 8 is in a direction substantially aligned with the longitudinal axis A. In all embodiments shown in the Figures and described herein, the passage 8 is generally cylindrical of a linear nature and its longitudinal axis A is aligned vertically. Thus, movement of the particles through the passage 8 is due to the influence of gravity. It will be appreciated, however, that a vertical alignment is not exclusively required as arrangements could be realised in which movement of the particles is achieved by other means, such as for example, gas flow.

With reference to FIGS. 1A-1C, the disperser 2 includes a downstream guide assembly (hereinafter, conditioning section 36) provided near the outlet region 16 which is configured for conditioning the flow of the particles so as to at least reduce any angular or rotational motion present in the flow (which is directed about the longitudinal axis A) so that the flow progresses in a more substantially uniform manner in a direction aligned with the longitudinal axis A of the passage 8 toward the outlet region 16. The downstream guide assembly is provided in the form of an assembly of a plurality (32 in total) of elongate ribs 40 (of square cross section, and approximately 10 mm×10 mm in the embodiment shown) spaced about and near the periphery of the passage 8 (or the interior wall of a cylindrical shroud provided in the form of a cylindrical tube section 28).

As shown in FIGS. 1A-1C, the elongate ribs 40 are arranged substantially parallel one another such that an elongate direction of each elongate ribs 40 is aligned with the longitudinal axis A of the passage 8. In this manner, the assembly of the elongate ribs 40 forms a cage like structure. The length of the elongate ribs 40 may be dimensioned as appropriate to the circumstance at hand.

As noted, the assembly of elongate ribs 40 serves to condition the flow of the particles prior to dispersion from the outlet region 16. In this manner, the elongate ribs 40 are configured or shaped so as to engage the passing flow of particles so as to at least reduce any non-uniformity in the flow so that it progresses toward the outlet region 16 in a manner more aligned with longitudinal axis A. This arrangement has been found to have the effect of improving the spatial distribution of the particles at or near the outlet region 16 for dispersal purposes. In some embodiments, the configuration of the conditioning section 36 serves to provoke or facilitate an increase in radial movement or scatter of the particles as they move toward the outlet region region 16 which, at least in part, reduces any component of angular or rotational motion in the flow.

The disperser 2 further comprises an upstream guide assembly (hereinafter, guide 20) arranged within the passage 8 and configured so as to modify the general path of travel of the particles through the passage 8 so as to cause movement of the particles about the longitudinal axis A as they move toward the outlet region 16.

Figure 13:
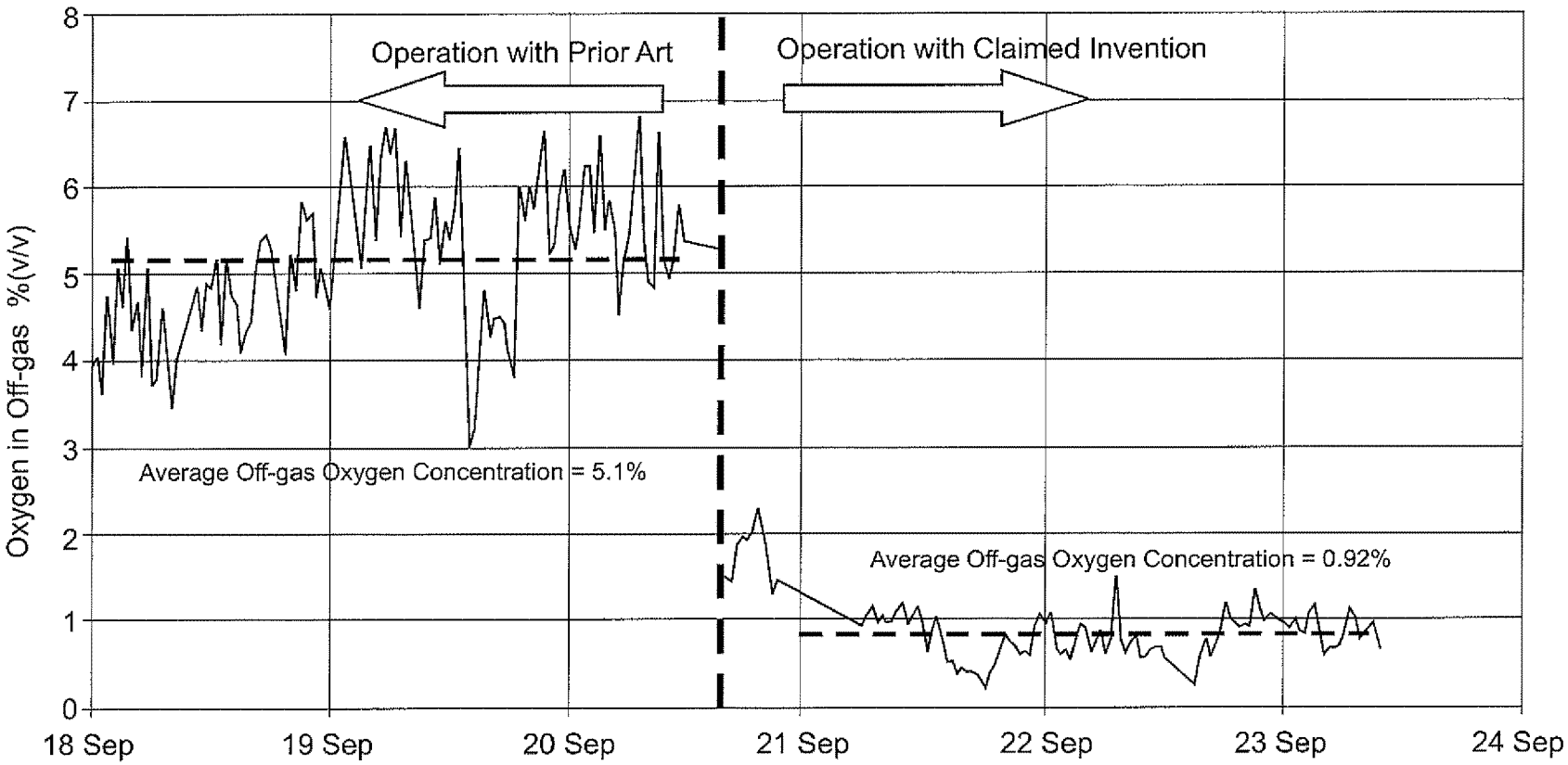
FIG. 13 shows, for one trial embodiment of a dispersion apparatus arranged in accordance with the principles described herein, the actual improvement in combustion efficiency observed at an industrial flash smelting facility, as compared to a conventional dispersion configuration.

The modification to the particle flow by way of the guide 20 serves to introduce a component of angular or rotational motion (ie. movement in a circumferential direction relative to the longitudinal axis A) into the flow so as to cause the particles to move radially outward from the axis A and toward the periphery of the passage 8. When subsequent conditioning of the flow is conducted by way of the conditioning section 36, a more spatially uniform distribution of the particles at or near the outlet region 16 is achieved which has been shown to improve combustion efficiency rates when used to feed a concentrate burner. When particles conditioned in this manner are released from disperser 2 into a subsequent combustion process, the efficiency levels of such combustion processes have been found to improve (as shown in FIG. 13). Thus, the disperser 2, and certain variations, may find favourable application in the fields of flash smelting of copper, lead or nickel concentrates, flash converting of sulphide mattes or other like fields where spatial uniformity of feed flow is considered advantageous.

The particles are introduced into the passage 8 by way of a feed means (such as for example a feed chute) provided at an inlet region 15 upstream of the guide 20. Thus, the inlet region 15 is fluidly connected to a feed chute 24 (see FIG. 3A). The passage 8 therefore serves as a conduit providing passage for the particles to travel toward the outlet region 16 for dispersal purposes.

The skilled person will appreciate that some feed arrangements will not introduce the particles in a symmetrical (in orientation and velocity) manner, thereby causing the particles to follow different trajectories within the passage 8 (albeit in the general downstream direction) and making it difficult to reliably condition the particles into a substantially uniform stream. Thus, the motion imparted by the guide 20 has been found to encourage the particles into a more predictable arrangement so that they can be more reliably conditioned by conditioning section 36 and dispersed from outlet region 16 more uniformly.

The disperser 2 further includes a shroud provided in the form of a section of cylindrical tube 28 which defines an outer wall of a portion of the passage 8. The section of cylindrical tube 28 extends along the passage 8 to the extent that it substantially surrounds the guide 20 and/or elongate ribs 40 of conditioning section 36 (as discussed further below). A ring 29 is provided about the uppermost end of the cylindrical tube 28 and arranged so as to prevent particles from entering the region between the cylindrical tube 28 and an outer sleeve of the disperser (not shown).

As noted, the guide 20 is configured so as to introduce a component of angular or rotational motion to the particles as they move from the feed chute 24 (see FIG. 3A) toward the outlet region 16. This component of angular or rotational motion serves to move the particles about their general direction of travel as they move toward the outlet region 16. The rotational motion assists in the development of centripetal forces which encourages the particles into a more predictable arrangement for subsequent conditioning.

For the embodiments shown throughout the Figures, the guide 20 comprises four spirals 32 which extend along a portion of the length of the guide 20. Each spiral 32 comprises a surface defined by a three dimensional curve wound uniformly about a portion of the longitudinal axis (which is aligned concentric with the longitudinal axis A) of the guide 20, at a distance outward therefrom (width dimension). The width dimension defines the outermost or peripheral edge of each spiral 32, and is generally uniform along each spiral's length.

The slope of each spiral 32 is a function of the pitch and the diameter (more specifically, the circumference)—which is the length of the spiral when measured parallel to its axis (for the embodiments shown and described herein, generally aligned with longitudinal axis A). The pitch of each spiral 32 is commensurate with the degree of angular velocity imparted to the particles.

For the majority of the embodiments shown in the Figures, the pitch of each spiral 32 is uniform along its length. However, the pitch can be non-uniform so to allow the rotational velocity component imparted to the particles to be varied along certain regions of the guide 20 (see the embodiment shown in FIG. 11 in which the pitch is varied along the length of the spiral section 156).

There is no finite number of times that each spiral 32 needs to wind about its axis—only sufficient length is required so that the particles are encouraged to move towards the periphery of the passage 8 so they reach the interior surface of the cylindrical tube 28. The length of each spiral 32 depends on how easily the particulate material flows. The skilled person will appreciate that a balance exists between the flow velocity of the material and the nature of the particulate material, ie. if the velocity of the particles is too slow, then the particles are (a), less likely to reach the periphery of the passage 8, and (b) blockages may occur. Thus, the flow velocity of the particles is controlled by the number of spirals employed, and their respective pitch. For the case of a more readily flowable particulate material, a guide arrangement having a flatter pitch with fewer spirals may be preferable. For a particulate material more resistant to flow, a guide arrangement having a steeper pitch (so to increase particle velocity) with a larger number of spirals may be more desirable.

With reference to FIGS. 2A, 2B and 2C, the spiral 32 features may be provided with a sidewall portion 22 arranged at or near the outermost or peripheral edge of the spiral 32. In this manner, the sidewall portion 22 is configured as an edge barrier portion for preventing particulate material from travelling beyond the periphery of the passage 8. As shown in at least FIG. 2C, the sidewall portion 22 is arranged so as to extend away from the edge region (and substantially upstream thereof) of the surface of the spiral 32 so as to restrain radial movement of the particles flowing therealong.

As shown in FIGS. 2A and 2B, the sidewall portion 22 is configured to extend along at least a portion of the peripheral edge of each spiral 32 at sections not covered by a section of the cylindrical tube 28. Thus, it will be understood that the sidewall portion 22, where ever provided, seeks to prevent the particles from moving beyond the extremities of the passage 8 and further assists in establishing the generally angular or rotational particle flow through and about the passage 8. It will be further appreciated that the sidewall portion 22 can be configured in any manner which serves the latter purpose. It will be appreciated that for embodiments of the disperser 2 in which the tube 28 completely covers the spirals 32, the need for the sidewall portion 22 might not exist.

The disperser 2 further comprises a column 18 extending from the inlet region 15 toward the outlet region 16 and about which the guide 20 is arranged. The column 18 is configured so as to provide support for the guide 20. The column 18 is provided in the form of a tubular elongate member of substantially uniform cross section along the majority of its length, terminating at a downstream end in the form of a cone portion 17, often referred to as a dispersion cone (shown in FIG. 8 and FIG. 9). The column 18 is configured for allowing a gas to flow through the hollow of the tubular region for release at the cone portion 17. The column 18 is arranged so that gas exiting from the cone portion 17 is directed so as to assist dispersion of the particles exiting from the outlet region 16 of the disperser 2. The column 18 and the guide 20 are fixed relative to one another.

With reference to FIGS. 3A to 3C, estimated flow streams are shown for two different particle feeding arrangements illustrating the predicted flow pattern of the particles caused by the spirals 32; FIG. 3A and FIG. 3C both show a single feed arrangement, and FIG. 3B shows a dual feed arrangement.

The conditioning section 36 may also include an annular ring 42 provided downstream of the elongate ribs 40 and provided at or near the periphery of the passage 8 (generally at or near the interior wall of the cylindrical tube 28).

The inlet region 15 comprises a manifold arrangement which serves to direct particles received from the feed chute 24 into an upstream region of the passage 8. The manifold arrangement is configured so as to divide incoming particulate matter into a number of streams of flow (generally four separate streams as shown), the configuration being such that each stream of flow is directed toward a respective spiral 32.

FIG. 4A and FIG. 4B each show diagrammatic representations of the estimated flow patterns of different embodiments of an entry region (15/15') which are each configured to transition the incoming particles from the feed chute to respective spirals 32. In FIG. 4A, the entry region 15 is configured with each spiral 32 having an extended portion 35 which extends sufficiently relative to the passage 8 so that the incoming feed impacts the portion 35 causing a substantial abrupt change in the state of flow (operating such as a deflector of the particles in some configurations). FIG. 4B shows an entry region 15' which is arranged such that a smooth transition from the feed chute to the spiral 32 is provided for. In the arrangement shown in FIG. 4B, the inlet is angled relative to the passage 8 so that the particles are introduced into the passage in a substantially tangential manner.

FIG. 4C shows the effect that the assembly of elongate ribs 40 are predicted to have on the particles exiting the spiral 32. It can be seen that the particles are substantially spatially uniformly distributed around the circumference of the interior wall of the cylindrical tube 28 as they continue to progress downward toward the outlet region 16.

Similarly, FIG. 5A and FIG. 5B show close up diagrammatic representations of the flow patterns observed by discrete element modelling showing the particle flow through the spirals 32 (FIG. 5A) and the conditioning section 36 (FIG. 5B).

A number of specific arrangements of disperser configurations are outlined below in the context of operational use in a conventional flash, concentrate or solid fuel burner.

Figure 8:
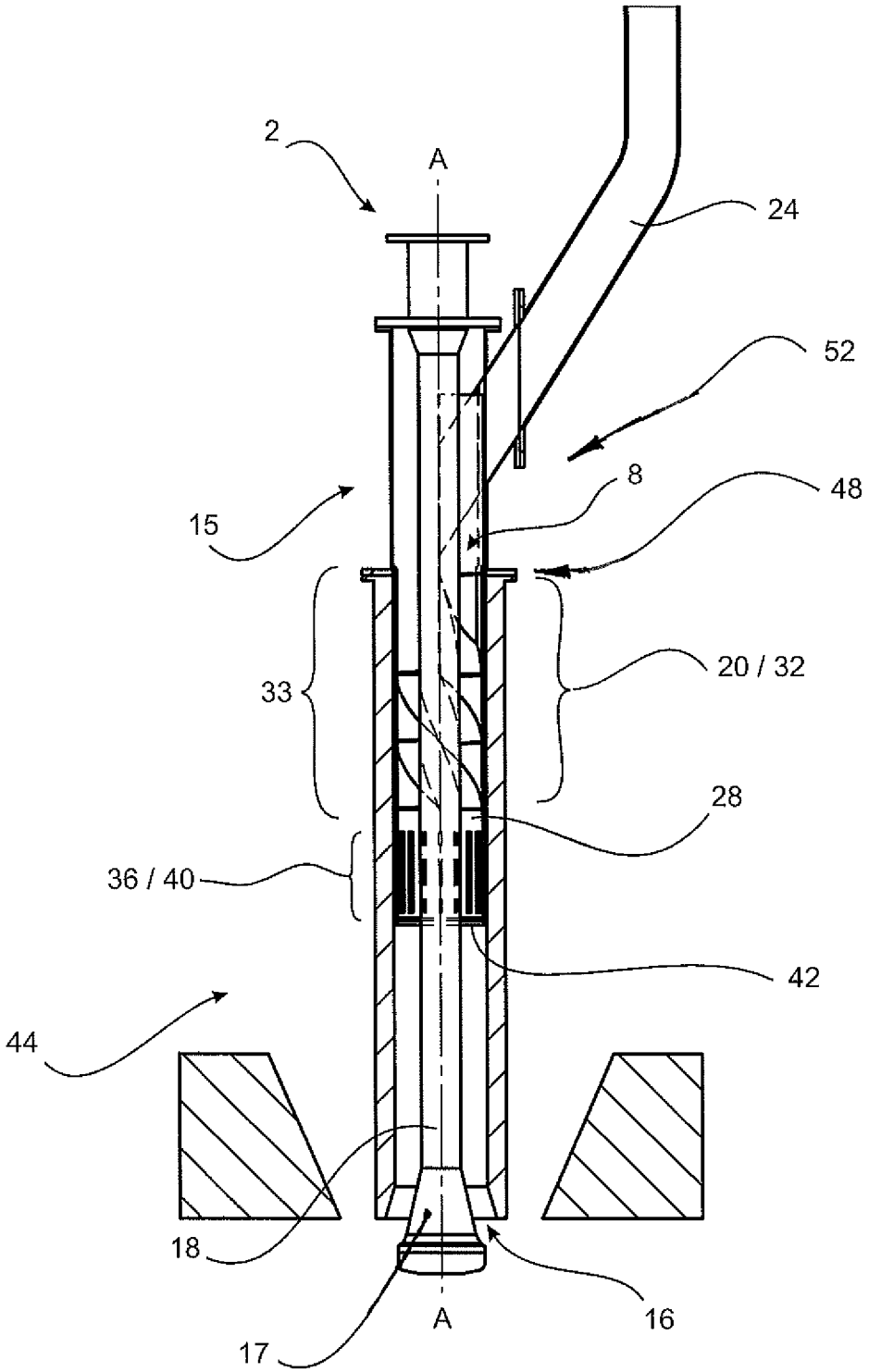
FIG. 8 shows an embodiment of the dispersion apparatus installed within a conventional single entry solid fuel burner.

FIG. 8 shows the embodiment of the disperser 2 shown in FIG. 1A to FIG. 1C, as mounted inside a conventional single-entry burner 44. The disperser 2 is fed by a single feed chute 24 which enters through the upper portion of a water cooled sleeve 48. Particulate material enters the disperser 2 through the feed chute 24 which is divided internally into four sections. Each section of the feed chute 24 feeds a baffled inlet 52. The baffled inlet 52 directs the four particle streams toward respective spirals 32 (generally hereinafter, spiral section 33) each of which then guides the particles toward and against the interior wall of the cylindrical tube 28.

Figure 12:
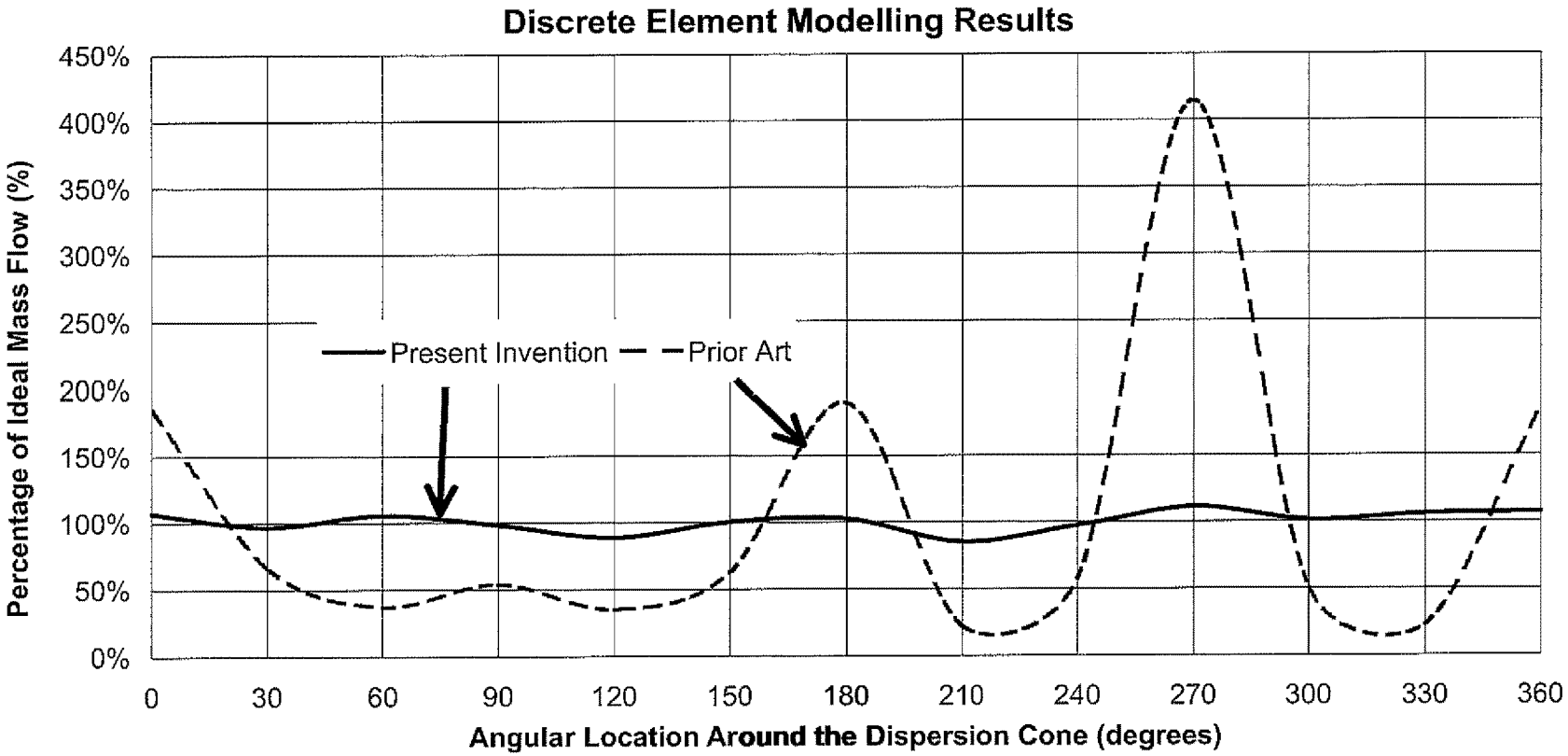
FIG. 12 shows, for one trial embodiment of a dispersion apparatus arranged in accordance with the principles described herein, a graphical representation of percentage of ideal mass mass flow versus angular location around the dispersion cone, as compared to a conventional dispersion configuration.

The particles exit the spiral section 33 with vertical and angular (circumferential) velocity components. As the particles interact with the elongate ribs 40, located in the conditioning section 36, their circumferential velocity component reduces. The particles then descend along the length of the conditioning section 36, and interact with annular ring 42 provided at the lowermost or downstream end of the elongate ribs 40, and aligned substantially transverse and concentric with the longitudinal axis A as shown. This interaction serves to provoke inter-particle collisions and/or scatter which leads to the particles becoming more evenly dispersed (as shown in FIG. 4C). The resulting mass flow rate distribution (marked, 'Present Invention'), presented in graphical form in FIG. 12, is shown to be advantageously more spatially uniform than that produced by a conventional disperser arrangement (marked, 'Prior Art').

Figure 9:
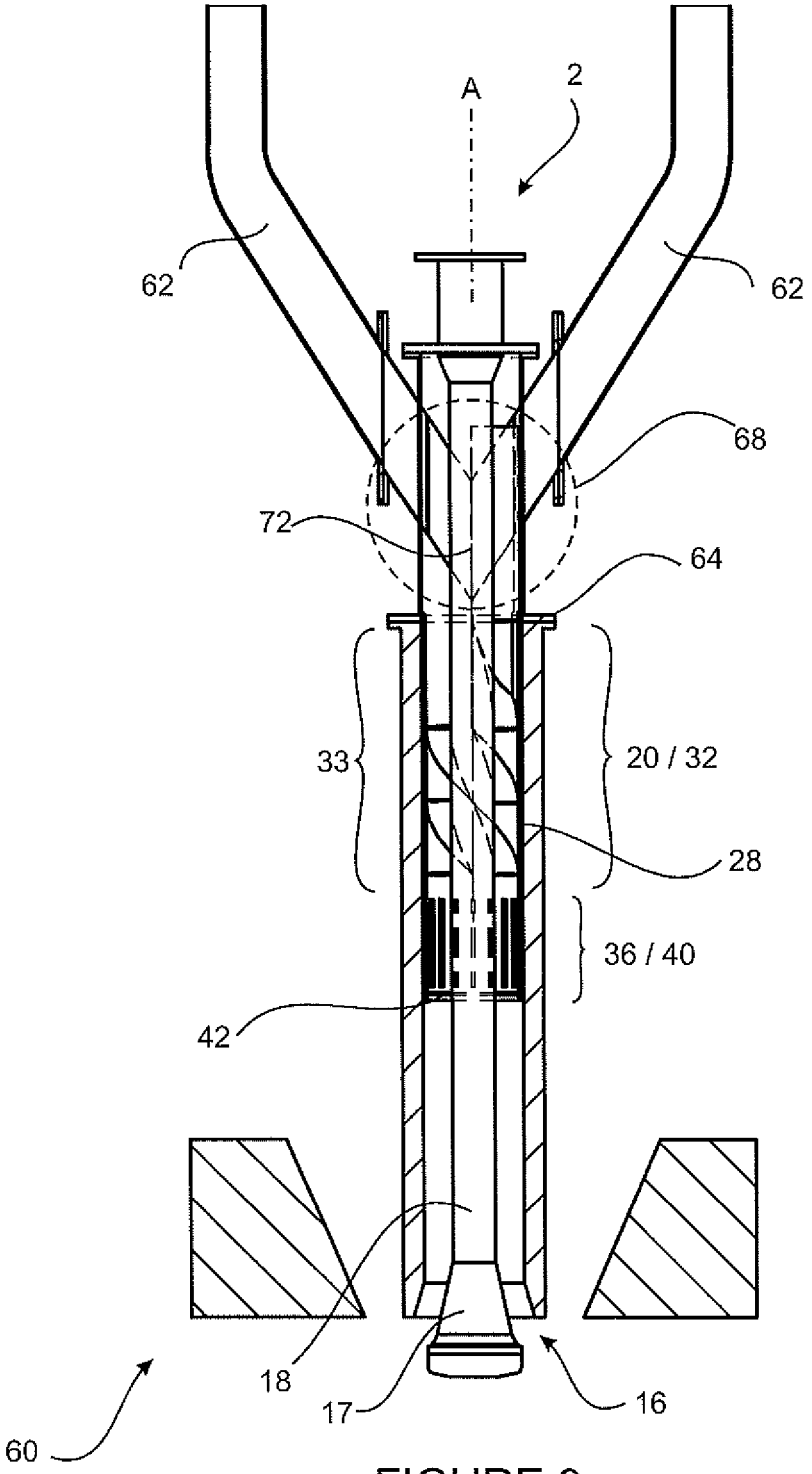
FIG. 9 shows a cut away view of an embodiment of the dispersion apparatus as mounted in, for example, a flash smelting burner incorporating a dual feed entry arrangement.

FIG. 9 shows an embodiment in which the disperser 2 is mounted inside a conventional double-entry burner 60. In this arrangement, the disperser 2 is fed by two feed chutes 62 which enter through an upper portion of a water-cooled sleeve 64. Concentrate particles enter the disperser 2 through the two feed chutes 62, each of which are divided into two sections thereby providing four streams of flowing particles. Each section of feed chute 62 feeds a baffled inlet 68 provided in the disperser 2. The baffled inlet 68 serves to direct the four particle streams to an entry region 72 upstream of the spirals 32. The spirals 32 then guide the particles toward and against the interior wall of the cylindrical tube 28.

The particles exit the spiral section 33 with vertical (downward direction) and circumferential velocity components, and encounter the conditioning section 36. As the particles interact with elongate ribs 40 in the conditioning section 36, their circumferential velocity component is reduced. The particles continue to descend along the length of the conditioning section 36 to then interact with the annular ring 42 in a manner previously described.

Figure 10:
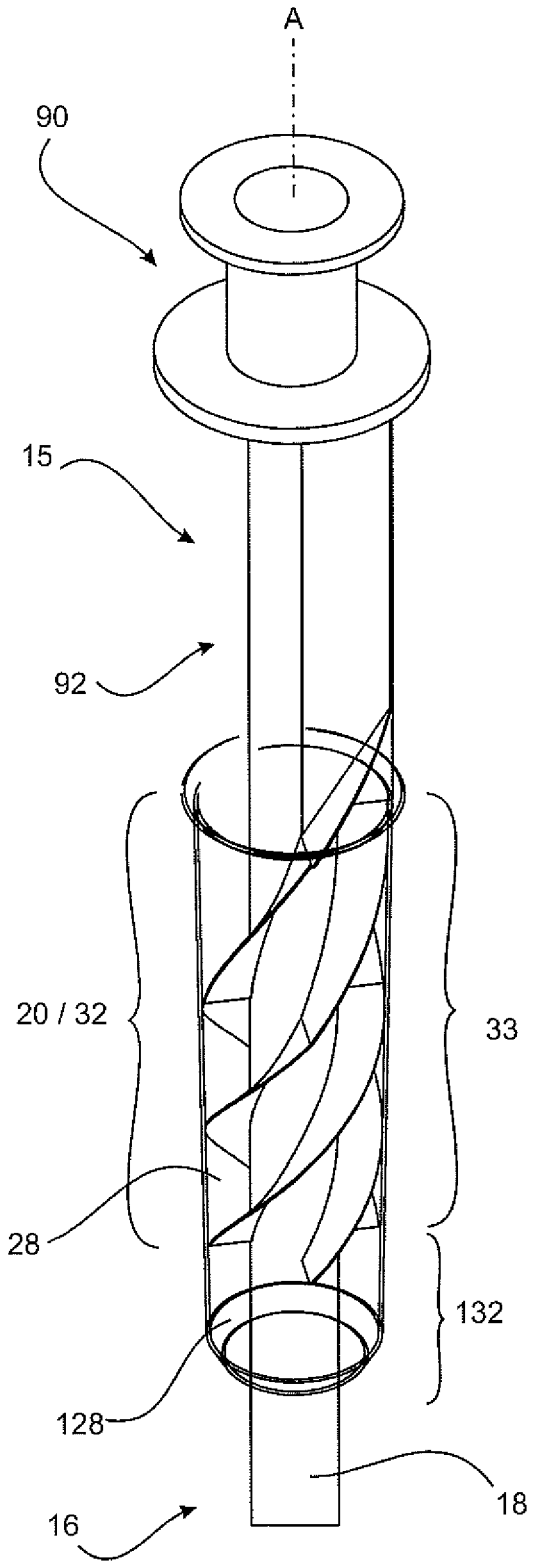
FIG. 10 shows an isometric view of another embodiment of a dispersion apparatus arranged in accordance with the present invention.

FIG. 10 shows an embodiment of a disperser 90 intended for mounting inside a conventional single-entry burner. In this arrangement, the cylindrical tube 28 tapers along its longitudinal axis in the direction of the particle flow. Furthermore, this embodiment of the disperser 90 omits elongate ribs 40, but comprises an internal nozzle ring (hereinafter, annular ring 128) positioned at or near the downstream end of a conditioning section 132 (analogous to the conditioning section 36). Particles enter the disperser 90 through a feed chute (24 as shown in FIG. 8) which is divided internally into four sections for feeding a baffled inlet region 92, so guiding each of the particle streams toward respective spirals 32 in spiral section 33.

The particles exit the spiral section 33 with vertical and circumferential velocity components. The particles then interact with the annular ring 128 located at the lower most edge of cylindrical tube 28 and are forced to alternately converge and diverge from the centre of the disperser 90. This arrangement serves also to promote inter-particle collisions thereby promoting greater spatial uniformity and conditioning the flow so as to progress in a more uniform manner in a direction aligned with the longitudinal axis A of the passage toward the outlet region 16.

Figure 11:
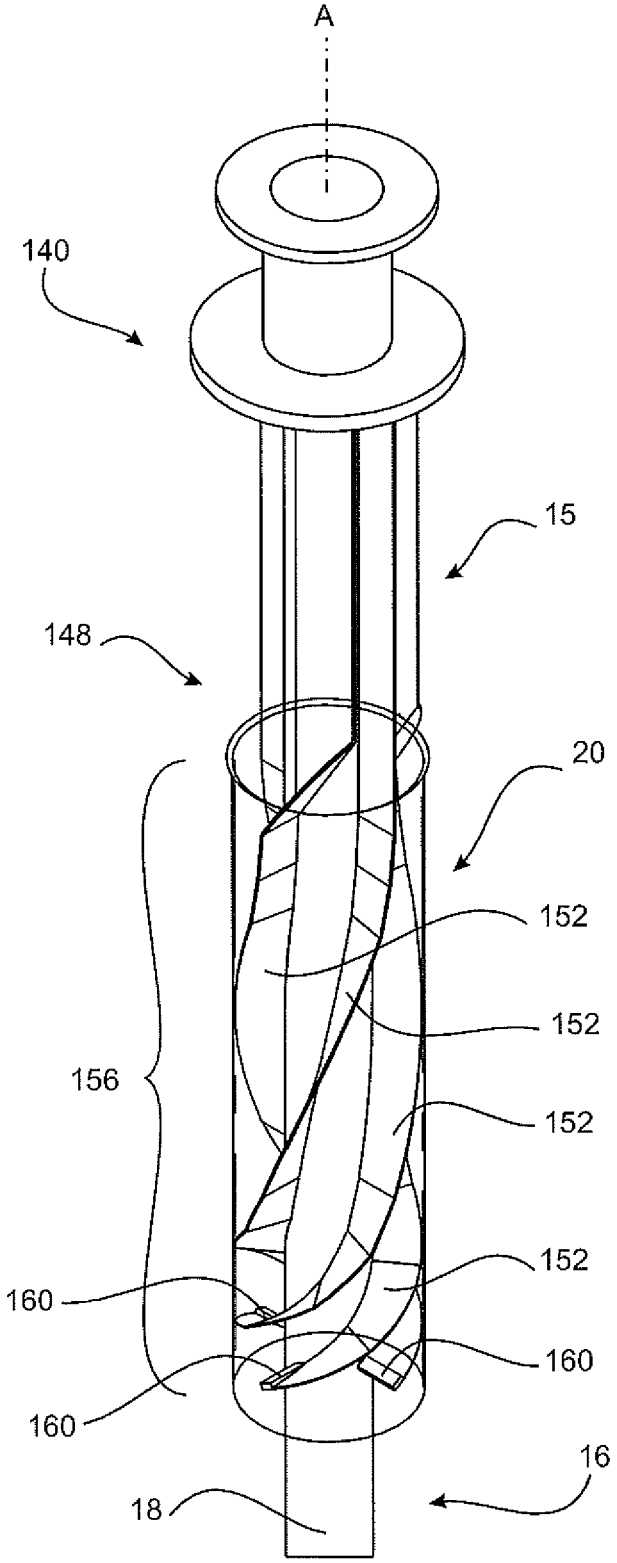
FIG. 11 shows an isometric view of a further embodiment of a dispersion apparatus arranged in accordance with the present invention.

FIG. 11 shows an embodiment of a disperser 140 for mounting within a water cooled sleeve (not shown), fed by a conventional single-entry feed arrangement. The particles enter the disperser 140 through a single feed chute (not shown) which is divided internally into four sections for feeding a baffled inlet region 148. The baffled inlet region 148 directs the four concentrate streams toward (respective) spirals 152 (in spiral section 156) which serve to guide the particles toward and against the interior wall of the water cooled sleeve 150 in which the disperser 140 is mounted. In this arrangement, the spirals 152 have a decreasing pitch along their respective lengths. This variable pitch arrangement serves to increase the angular velocity component of the particle stream as it passes through the length spiral section 156. When the particles exit the spiral section 156, they continue to move along or adjacent the interior wall of the water-cooled sleeve 150 and lose their angular velocity due to, at least in part, friction caused by contact with the interior wall of the water-cooled sleeve. In this arrangement, the spirals 156 each terminate with wedge like portions 160 which serve to engage with the passing flow so as to provoke interparticle scatter/movement for reducing the angular or rotational motion present in the flow.

FIG. 13 shows the actual improvement in combustion efficiency observed at an industrial flash smelting facility, when utilising embodiments of the claimed invention compared to conventional arrangements typical of prior art configurations. For a four day period, operating with consistent feed characteristics, feed rate, and product quality, the remnant oxygen in the smelter off-gas was found to be reduced significantly when a disperser arranged in accordance with the principles of the present invention was in use. As will be clear from FIG. 13, the level of oxygen present in the smelter off-gas is seen to drop from an average in excess of 5% to less than 1% due to the improved combustion effecting a near complete consumption of the available oxygen.

The skilled reader will appreciate that various configurations seeking to condition the flow at or near the outlet region of the disperser 2 are possible. For example, in another embodiment (not shown), the cylindrical tube 28 may be arranged so as to taper along its longitudinal axis in the direction of the particle flow, and the conditioning section 36 provided at any region within the tapering section of the cylindrical tube 28. As one example arrangement of this type, the conditioning section 36 could be arranged having two annular rings: a trailing annular ring provided at or near the downstream most end of the cylindrical tube 28, and a leading annular ring provided at or near the entrance to the conditioning section 36 and, of course, upstream of the trailing annular ring.

In an arrangement of this nature, particles enter the disperser through a feed chute (which might be again, for example, subdivided internally into four sections for feeding a baffled inlet provided in the disperser). The baffled inlet guides the four particle streams toward respective spirals 32 which then guides the particles toward and against the interior wall of cylindrical tube 28. It will be understood that the particles exit the spiral section 33 with vertical and circumferential velocity components.

As the particles engage or interact with the leading annular ring located at or near the entrance to the conditioning section 132, they are forced to alternately converge and diverge from the centre of the disperser. The trailing annular ring may be provided having one or more lip or protruding formations which serve to encourage further particle scatter upon impact. Arrangements of this nature can be therefore assist in promoting inter-particle collisions and/or scatter, so promoting increased radial movement and which has been found to lead to a more uniform circumferential particle distribution for improving spatial uniformity.

The skilled reader will readily appreciate the materials and manufacturing techniques which might be relevant for constructing the componentry described herein. For example, 316 stainless steel finds broad application to many embodiments of the apparatus, as does various lower grade carbon steels and other stainless steel specifications.

The words used in the specification are words of description rather than limitation, and it is to be understood that various changes may be made without departing from the spirit and scope of the invention. Those skilled in the art will readily appreciate that a wide variety of modifications, alterations, and combinations can be made with respect to the above described embodiments without departing from the spirit and scope of the invention, and that such modifications, alterations, and combinations are to be viewed as falling within the ambit of the inventive concept.

Moreover, the word 'comprising' and forms of the word comprising as used in this description, and the claims which follow, are not intended to be limited to the invention claimed so as to exclude any such modifications, alterations, and combinations. Furthermore, the word "include" or variations such as "includes" or "including", will be understood to imply the inclusion of a stated integer or group of integers but not the exclusion of any other integer or group of integers.

The claims defining the invention are as follows:

1. A dispersion apparatus for use in conditioning the flow of a particulate material flowing therethrough, the apparatus comprising:

a passage through which particulate material may flow from an inlet region toward an outlet region for dispersal therefrom, the flow being at least in part, rotational about a longitudinal axis of the passage;

a downstream guide arranged within the passage, the downstream guide configured to at least reduce the rotational motion so that the flow progresses from the downstream guide toward the outlet region in a substantially uniform manner in a direction aligned with the longitudinal axis of the passage;

an upstream guide provided upstream of the downstream guide and configured for introducing into the flow a component of angular or rotational motion for moving the particulate material about the longitudinal axis of the passage;

wherein the upstream guide comprises more than one spiral, the spirals arranged within the passage and configured so as to extend along the passage from the inlet region to the downstream guide; and wherein the inlet region comprises a manifold arrangement which serves to direct the particulate material into an upstream region of the passage, wherein the manifold arrangement is configured to divide incoming particulate material into a number of streams of flow, such that each stream of flow is directed toward a respective spiral.

2. A dispersion apparatus according to claim 1, wherein the inlet region comprises an inlet configured so as to introduce the particulate material into the passage in a direction tangential thereto.

3. A dispersion apparatus according to claim 1, wherein the spiral comprises a sidewall portion provided at a peripheral edge region of the spiral and arranged for preventing the particulate material travelling beyond the periphery of the passage at the peripheral edge region, the sidewall portion arranged so as to extend along at least a portion of the peripheral edge region.

4. A dispersion apparatus according to claim 1, wherein the downstream guide comprises one or more protrusions arranged about the longitudinal axis of the passage, the or each protrusion configured so as to engage with the passing flow of particulate material.

5. A dispersion apparatus according to claim 1, wherein the downstream guide comprises one or more annular rings arranged concentric with the passage and configured so as to engage with the passing flow of particulate material.

6. A dispersion apparatus according to claim 1, wherein the downstream guide comprises a plurality of elongate elements spaced about a periphery of the passage and configured so as to engage with the passing flow of particulate material, each elongate element having an elongate direction which is aligned with the longitudinal axis of the passage.

7. A dispersion apparatus according to claim 1, further comprising a shroud member which is configured to define at least a portion of the passage.

8. A dispersion apparatus according to claim 7, wherein the shroud member surrounds a portion of the downstream guide or upstream guide.

9. A dispersion apparatus according to claim 7, wherein the passage is defined, at least in part, by an interior surface of an annular channel in which the dispersion apparatus is installed.

10. A dispersion apparatus according to claim 1, wherein the flow of a particulate material is a mixture of gas and solid particles.

11. A method for modifying the path of travel of particulate material flowing through a passage of a dispersion apparatus or dispersion lance from which the particulate material is to be dispersed from, the method comprising:

introducing into the flow of particulate material at an inlet region of the passage upstream and proximal of an outlet region, a component of angular or rotational motion for moving the particulate material about the longitudinal axis of the passage by providing more than one spiral within the passage, the spiral configured to extend along the passage from the inlet region to a downstream guide;

directing the particulate material into an upstream region of the passage with a manifold arrangement, wherein the manifold arrangement divides the particulate material into a number of streams of flow, such that each stream of flow is directed toward a respective spiral; and modifying the path of flow of the particulate material using the downstream guide of the dispersion apparatus or dispersion lance to at least reduce any rotational motion of the flow about a longitudinal axis of the passage so that the flow progresses from the downstream guide toward the outlet region in a substantially uniform manner in a direction aligned with the longitudinal axis of the passage.

12. A method according to claim 11, wherein introducing the component of angular or rotational motion into the flow comprises introducing the particulate material into the passage in a direction tangential thereto.

13. A method according to claim 11, wherein modifying the path of flow of the particulate material at the outlet region comprises providing one or more protrusions arranged about the longitudinal axis of the passage, the or each protrusion configured so as to engage with the passing flow of particulate material.

14. A method according to claim 11, wherein modifying the path of flow of the particulate material at the outlet region comprises providing a plurality of elongate elements spaced about a periphery of the passage and configured so as to engage with the passing flow of particulate material, each elongate element having an elongate direction which is aligned with the longitudinal axis of the passage.

15. A method according to claim 11, wherein the flow of particulate material is a mixture of gas and solid particles.

* * * * *